US009939832B2

(12) United States Patent
Duong et al.

(10) Patent No.: US 9,939,832 B2
(45) Date of Patent: Apr. 10, 2018

(54) VOLTAGE REGULATOR AND INTEGRATED CIRCUIT INCLUDING THE SAME

(71) Applicant: SAMSUNG ELECTRONICS CO., LTD., Suwon-si, Gyeonggi-do (KR)

(72) Inventors: Hoang Quoc Duong, Seoul (KR); Dong Jin Keum, Suwon-si (KR); Hyun Seok Shin, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/360,674

(22) Filed: Nov. 23, 2016

(65) Prior Publication Data

US 2017/0269620 A1 Sep. 21, 2017

(30) Foreign Application Priority Data

Mar. 15, 2016 (KR) ..... 10-2016-0031134

(51) Int. Cl.

| | |
|---|---|
| ***G05F 1/575*** | (2006.01) |
| ***G05F 1/63*** | (2006.01) |
| ***G05F 1/56*** | (2006.01) |
| ***G05F 1/565*** | (2006.01) |

(52) U.S. Cl.

CPC ..... *G05F 1/575* (2013.01); *G05F 1/56* (2013.01); *G05F 1/565* (2013.01); *G05F 1/63* (2013.01)

(58) Field of Classification Search

CPC ..... G05F 1/57; G05F 1/575

See application file for complete search history.

(56) References Cited

U.S. PATENT DOCUMENTS

| | | | | |
|---|---|---|---|---|
| 6,137,726 | A * | 10/2000 | Choi | G11C 16/30 365/185.24 |
| 6,388,519 | B1 | 5/2002 | Tachimori | |
| 6,946,820 | B2 | 9/2005 | Ishii et al. | |
| 7,256,568 | B2 | 8/2007 | Lam et al. | |
| 7,646,108 | B2 | 1/2010 | Paillet et al. | |
| 8,022,681 | B2 | 9/2011 | Gurcan | |
| 8,344,713 | B2 | 1/2013 | Shrivas et al. | |
| 8,860,389 | B2 | 10/2014 | Gakhar et al. | |
| 2002/0041178 | A1 * | 4/2002 | Hiraki | G06F 1/26 323/272 |
| 2004/0027104 | A1 | 2/2004 | Ishii et al. | |
| 2008/0231115 | A1 | 9/2008 | Cho et al. | |
| 2010/0109435 | A1 | 5/2010 | Ahmadi et al. | |

(Continued)

OTHER PUBLICATIONS

"LV5683P Multi Voltage Regulator IC for Car Audio Systems," Semiconductor Components Industries, LLC, 2013, Dec. 2013.

*Primary Examiner* — Jue Zhang
*Assistant Examiner* — Trinh Q Dang
(74) *Attorney, Agent, or Firm* — Volentine & Whitt, PLLC

(57) ABSTRACT

A voltage regulator is provided that includes an error amplifier circuit having a reference voltage input port that receives a reference voltage, N input ports, N output ports, and N power transistors, where N is a positive integer that is greater than or equal to 2. Each of the power transistors has a gate that is connected to one of the N output ports. The error amplifier amplifies a difference between the reference voltage and each of N respective feedback voltages input to the N input ports, respectively, and outputs amplified voltages to the respective N output ports.

20 Claims, 14 Drawing Sheets

(56) References Cited

U.S. PATENT DOCUMENTS

| | | | | |
|---|---|---|---|---|
| 2012/0062031 | A1 | 3/2012 | Buthker | |
| 2013/0154507 | A1 | 6/2013 | Gilliom | |
| 2013/0241649 | A1 | 9/2013 | Fort et al. | |
| 2013/0257401 | A1 | 10/2013 | Fort et al. | |
| 2013/0293208 | A1 | 11/2013 | D'Angelo et al. | |
| 2014/0266088 | A1* | 9/2014 | Makino | G05F 1/563 323/266 |

* cited by examiner

VOLTAGE REGULATOR AND INTEGRATED CIRCUIT INCLUDING THE SAME

PRIORITY STATEMENT

This application claims priority under 35 U.S.C. §119(a) to and the benefit of the filing data of Korean Patent Application No. 10-2016-0031134 filed on Mar. 15, 2016, the disclosure of which is hereby incorporated by reference herein in its entirety.

TECHNICAL FIELD OF THE INVENTION

The invention relates to voltage regulators.

BACKGROUND

While advanced functionality of mobile devices increases with the rapid development of mobile devices, the capacity of batteries of mobile devices remains limited. For this reason, most mobile device manufacturers put more effort into increasing the use time of mobile devices rather than increasing battery capacity. In other words, most mobile device manufacturers focus more on improving battery use efficiency than increasing battery capacity.

Mobile devices typically include a low-dropout (LDO) regulator that is provided with an operating voltage from a power management IC included in the mobile device. The LDO regulator converts the operating voltage into an output voltage that is provided to a semiconductor chip of the mobile device. The LDO regulator needs to obtain a sufficient dropout voltage, i.e., a difference between an input voltage and an output voltage of the LDO regulator, in order to correctly generate the output voltage that is provided to the semiconductor chip. The LDO regulator has a feedback loop that includes an error amplifier and a power transistor. The error amplifier measures the difference between a reference voltage and the output voltage and adjusts the gate voltage of the power transistor in order to regulate the dropout voltage of the LDO regulator.

If the dropout voltage is too small, the overall feedback loop gain of the LDO regulator decreases. As a result, a large error occurs in the output voltage of the LDO regulator. However, although a sufficient dropout voltage is needed to prevent errors in the output voltage of the LDO regulator, the power efficiency of the LDO regulator decreases as the dropout voltage increases.

In some cases, a single LDO regulator is required to provide a plurality of output voltages. If a plurality of error amplifiers are used to provide the LDO regulator with a plurality of output voltages, the size of the chip that incorporates the LDO regulator and driving current may increase with the increase in the number of error amplifiers, which are undesirable effects.

SUMMARY

A voltage regulator and an integrated circuit (IC) that incorporates the voltage regulator are provided. In accordance with an exemplary embodiment, the voltage regulator comprises an error amplifier circuit and first and second power transistors. The error amplifier circuit comprises first and second amplifiers and first, second and third transistors. The first amplifier is configured to generate a first output signal by amplifying a difference between a reference voltage input to a first gate of the first transistor and a first feedback voltage input to a second gate of the second transistor. The second amplifier is configured to generate a second output signal by amplifying a difference between the reference voltage input to the first gate of the first transistor and a second feedback voltage input to a third gate of the third transistor. The first power transistor is configured to be placed in an on or off state in response to the first output signal. The second power transistor configured to be placed in an on or off state in response to the second output signal In accordance with an exemplary embodiment, the IC comprises at least one power source and a voltage regulator. The power source is configured to supply an operating power. The voltage regulator receives the operating power supplied by the power source. The voltage regulator comprises an error amplifier circuit and first and second power transistors. The first amplifier is configured to generate a first output signal by amplifying a difference between a reference voltage input to a first gate of the first transistor and a first feedback voltage input to a second gate of the second transistor. The second amplifier is configured to generate a second output signal by amplifying a difference between the reference voltage input to the first gate of the first transistor and a second feedback voltage input to a third gate of the third transistor. The first power transistor is configured to be placed in an on or off state in response to the first output signal. The second power transistor is configured to be placed in an on or off state in response to the second output signal.

These and other features and advantages of the inventive concepts will become apparent from the following description, drawings and claims.

BRIEF DESCRIPTION OF THE DRAWINGS

The above and other features and advantages of the inventive concept will become more apparent by describing in detail exemplary embodiments thereof with reference to the attached drawings in which.

DETAILED DESCRIPTION OF THE EMBODIMENTS

In the following detailed description, for purposes of explanation and not limitation, example embodiments disclosing specific details are set forth in order to provide a thorough understanding of an embodiment according to the inventive principles and concepts. However, it will be apparent to one having ordinary skill in the art having the benefit of the present disclosure that other embodiments according to the present disclosure that depart from the specific details disclosed herein remain within the scope of the appended claims. Moreover, descriptions of well-known devices, elements or components may be omitted so as to not obscure the description of the example embodiments. Such devices, elements or components are clearly within the scope of the present disclosure. It should also be understood that the word "example," as used herein, is intended to be non-exclusionary and non-limiting in nature. More particularly, the word "exemplary" as used herein indicates one among several examples, and it should be understood that no undue emphasis or preference is being directed to the particular example being described.

It should be noted that when an element or component is referred to herein as being "connected to" or "coupled to" or "electrically coupled to" another element or component, it can be directly connected or coupled, or intervening elements may be present. It will be understood that, although the terms first, second, etc. may be used herein to describe various elements, these elements should not be limited by these terms. These terms are only used to distinguish one element from another. For example, a first signal could be termed a second signal, and, similarly, a second signal could be termed a first signal without departing from the teachings of the disclosure.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this disclosure pertains. It will be further understood that terms, such as those defined in commonly used dictionaries, should be interpreted as having a meaning that is consistent with their meaning in the context of the relevant art unless expressly defined differently herein.

Figure 1:
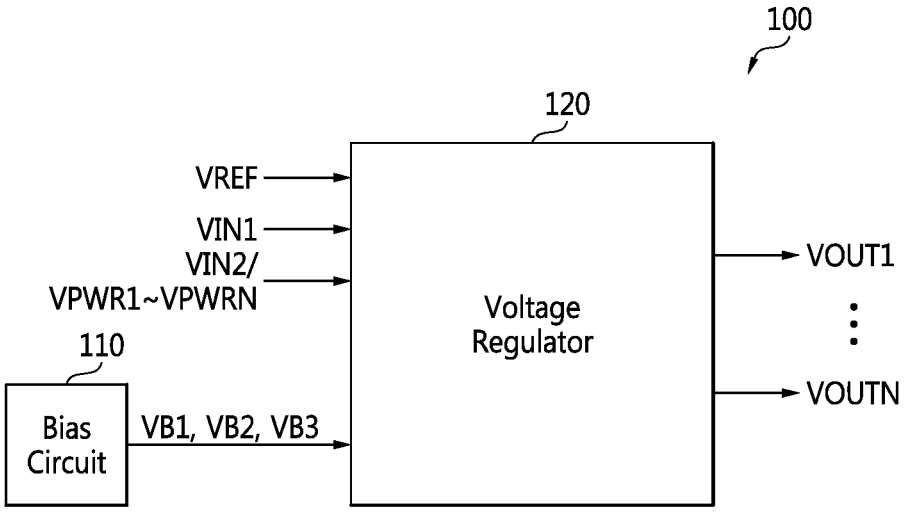
FIG. 1 is a block diagram of an integrated circuit (IC) in accordance with an exemplary embodiment.

A few Illustrative, or exemplary, embodiments will now be described with reference to the figures, in which like reference numerals represent like elements, components or features. The figures are not intended to be drawn to scale, emphasis instead being placed on describing inventive principles and concepts. FIG. 1 is a block diagram of an integrated circuit (IC) 100 in accordance with an illustrative embodiment. The IC 100 includes a bias circuit 110 and a voltage regulator 120. In accordance with this embodiment, the bias circuit 110 generates first, second and third bias voltages VB1, VB2, and VB3, respectively, and supplies them to the voltage regulator 120. Although the bias circuit 110 is shown in FIG. 1 as being external to the voltage regulator 120, in other embodiments the bias circuit 110 is internal to the voltage regulator 120. In accordance with this embodiment, the voltage regulator 120 receives a plurality of driving voltages VIN1, VIN2, and/or VPWR1 through VPWRN, a reference voltage VREF, and the bias voltages VB1, VB2, and VB3, where N is a positive integer that is greater than or equal to 2. The voltage regulator 120 changes the level of the driving voltages VIN1, VIN2, and/or VPWR1 through VPWRN and outputs level-changed driving voltages. In accordance with this embodiment, the voltage regulator 120 is a low-dropout (LDO) regulator.

Figure 2:
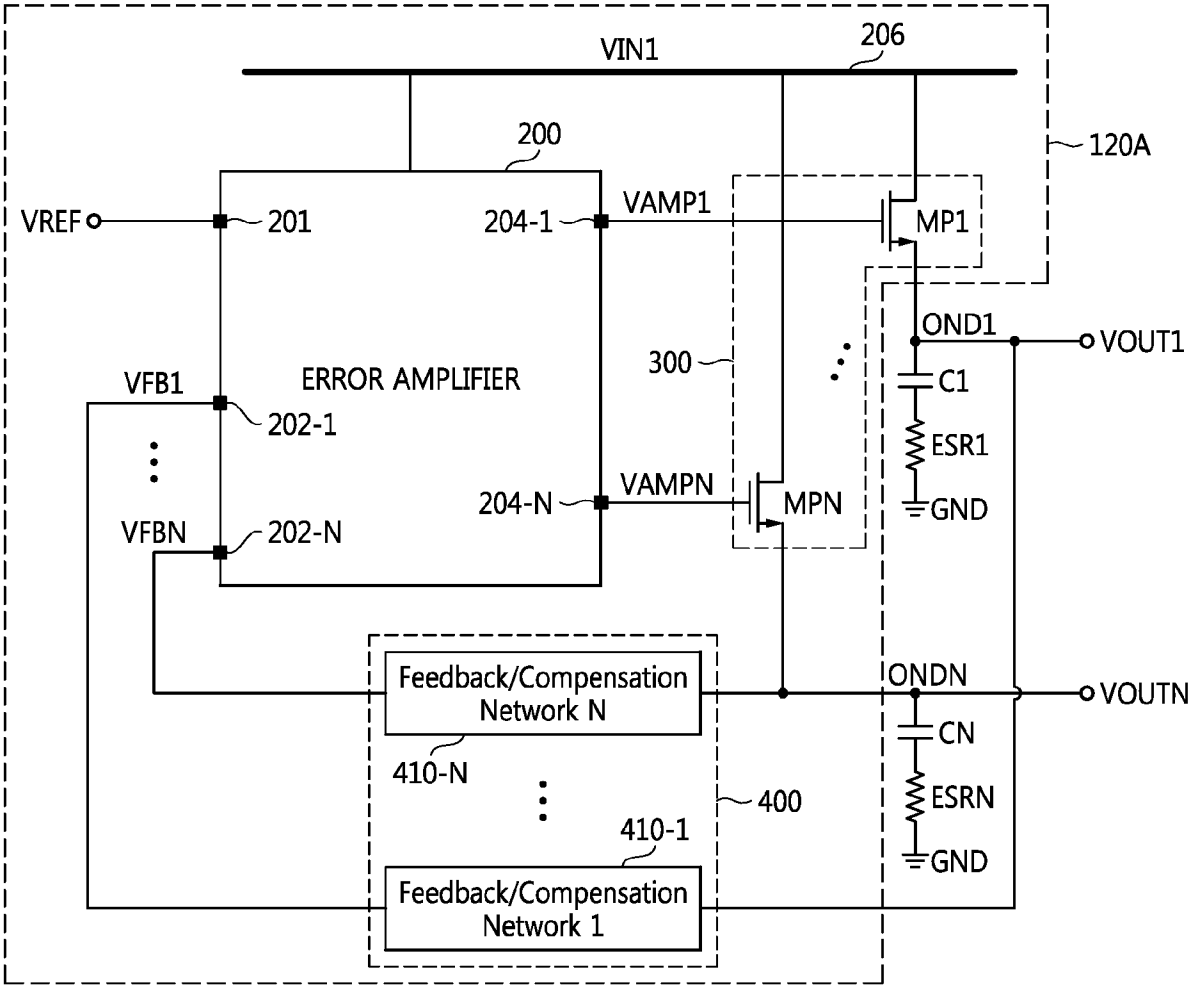
FIG. 2 is a block diagram of a voltage regulator illustrated in FIG. 1 in accordance with an exemplary embodiment.

FIG. 2 is a block diagram of an example 120A of the voltage regulator 120 illustrated in FIG. 1. Referring to FIGS. 1 and 2, the voltage regulator 120A includes an error amplifier 200, a power transistor circuit 300, and a feedback network 400. For exemplary purposes, capacitors C1 through CN and resistors ESR1 through ESRN are shown connected in series between a ground GND and a plurality of output nodes OND1 through ONDN, respectively, of the voltage regulator 120A.

The error amplifier 200 includes a reference voltage input port 201, a plurality of input ports 202-1 through 202-N, and a plurality of output ports 204-1 through 204-N. The error amplifier 200 receives the reference voltage VREF through the reference voltage input port 201 and receives a plurality of feedback voltages VFB1 through VFBN through the input ports 202-1 through 202-N, respectively. The error amplifier 200 outputs a plurality of amplified voltages VAMP1 through VAMPN to the power transistor circuit 300 through the output ports 204-1 through 204-N, respectively.

The error amplifier 200 uses, as an operating voltage, the first input voltage VIN1 supplied to the error amplifier 200 through a first voltage supply node 206 and amplifies the difference between the reference voltage VREF and each of the feedback voltages VFB1 through VFBN. The error amplifier 200 may be implemented as, for example, an operational amplifier. The error amplifier 200 acts as a controller and may be referred to herein as such.

The reference voltage VREF may be input to the error amplifier 200 to a positive terminal of the error amplifier 200 and all or at least one of the feedback voltages VFB1 through VFBN may be input to a negative terminal of the error amplifier 200. When configured in this manner, if all or at least one of the feedback voltages VFB1 through VFBN input to the negative terminal(s) increases, the plurality of the amplified voltages VAMP1 through VAMPN output from the error amplifier 200 decrease, and when all or at least one of the feedback voltages VFB1 through VFBN decreases, the plurality of the amplified voltages VAMP1 through VAMPN of the error amplifier 200 increase.

The error amplifier 200 also controls the gate of power transistors MP1 through MPN using the first input voltage VIN1 and a ground voltage GND as operating voltages. The power transistor circuit 300 is electrically coupled between the first voltage supply node 206 and the output ports 204-1 through 204-N of the error amplifier 200 and controls the levels of the output voltages VOUT1 through VOUTN and/or whether to output the output voltages VOUT1 through VOUTN based on the plurality of amplified voltages VAMP1 through VAMPN of the error amplifier 200, i.e., based on the gate voltages of the power transistors MP1 through MPN.

The $i^{th}$ output voltage VOUTi (where "i" is a positive integer that is greater than or equal to 1 and less than or equal to N) among the output voltages VOUT1 through VOUTN of the power transistor circuit 300 can be expressed by Equation 1 as:

$$VOUTi = \left(1 + \frac{R1 - i}{R2 - i}\right) * VREF, \quad (1)$$

where R1-*i* and R2-*i* denote output resistances connected to the i-th output node ONDi. The power transistors MP1 through MPN may be implemented as, for example, N-channel metal-oxide semiconductor (NMOS) transistors.

The feedback network 400 may include a plurality of feedback circuits 410-1 through 410-N. In other embodiments, the feedback network 400 may include a single feedback circuit. The feedback network 400 is electrically coupled to the output nodes OND1 through ONDN and to the input ports 202-1 through 202-N of the error amplifier 200 and generates the feedback voltages VFB1 through VFBN based on the output voltages VOUT1 through VOUTN of the output nodes OND1 through ONDN, respectively. In some embodiments in which the feedback network 400 includes a single feedback circuit, the feedback network 400 generates a single feedback voltage.

As shown in FIGS. 3A and 3B, FIGS. 5A and 5B, FIGS. 7A and 7B, and FIGS. 9A and 9B, the feedback circuit 410-*i* may be formed of a voltage divider including a plurality of the resistors R1-*i* and R2-*i*. In other words, a divided voltage of the voltage divider 410-*i* may be provided as the feedback voltage VFBi for the error amplifier 200. The feedback voltage VFBi may be dependent on the output voltage VOUTi.

Figure 3A:
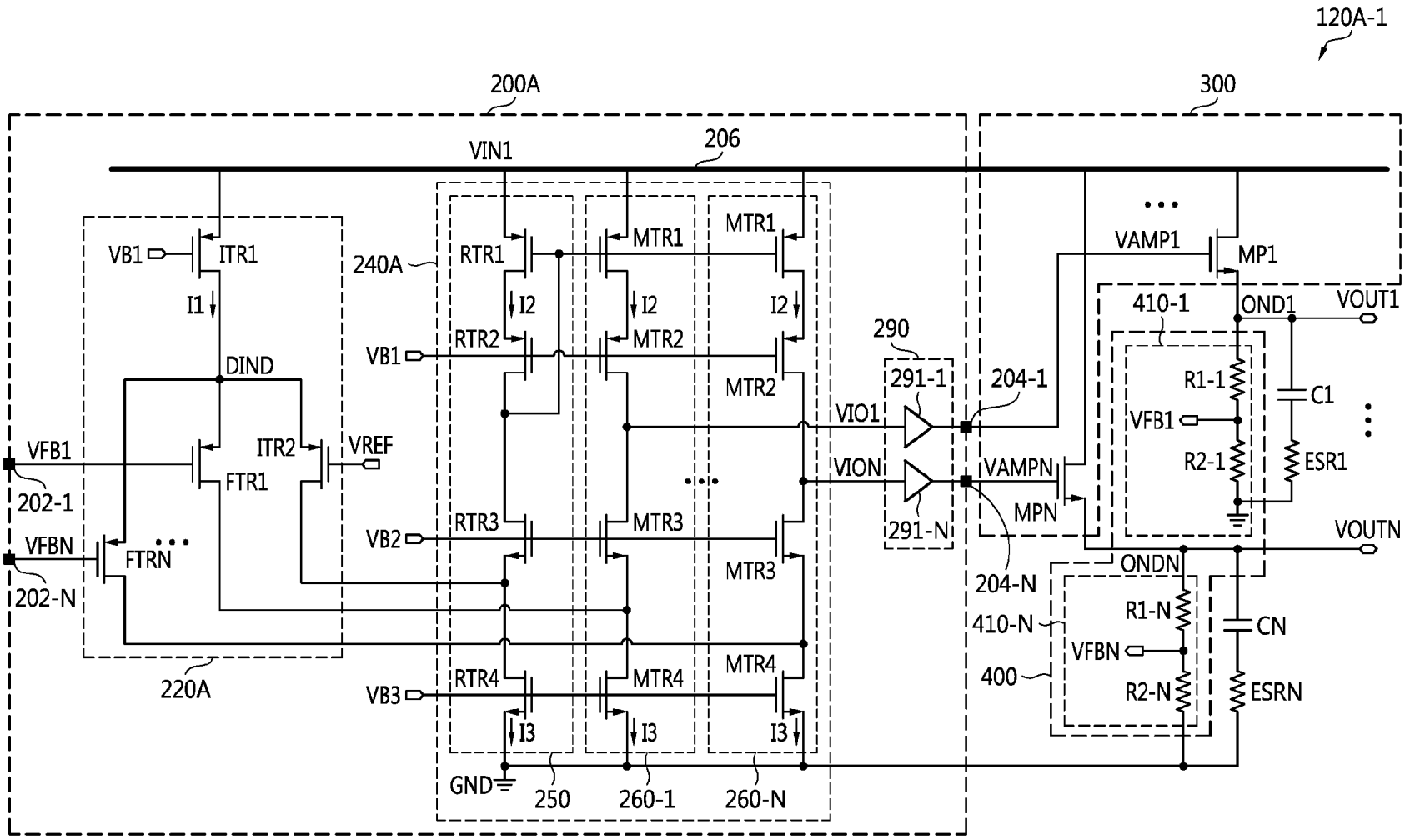
FIG. 3A is a detailed block diagram of the voltage regulator illustrated in FIG. 2 in accordance with an exemplary embodiment.

FIG. 3A is a detailed block diagram of an example 120A-1 of the voltage regulator 120A illustrated in FIG. 2. Referring to FIGS. 1, 2, and 3A, the voltage regulator 120A-1 includes an error amplifier 200A, the power transistor circuit 300, and the feedback network 400. In this example, capacitors C1 through CN and resistors ESR1 through ESRN are connected in series between the ground GND and the output nodes OND1 through ONDN of the voltage regulator 120A-1.

The error amplifier 200A includes a differential input circuit 220A, a current summing circuit 240A and a buffer circuit 290. The error amplifier 200A controls the gates of the power transistors MP1 through MPN of the power transistor circuit 300 using the first input voltage VIN1 and the ground voltage GND as operating voltages. The error amplifier 200A uses the first input voltage VIN1 supplied through the first voltage supply node 206 and the ground voltage GND supplied through the ground GND as the operating voltages, amplifies the difference between the reference voltage VREF and each of the feedback voltages VFB1 through VFBN, and outputs the amplified voltages VAMP1 through VAMPN.

In accordance with this embodiment, the differential input circuit 220A includes a current summing transistor ITR1, a reference voltage transistor ITR2, and a plurality of differential input transistors FTR1 through FTRN. The number of the differential input transistors FTR1 through FTRN that are used may change according to various embodiments.

Each of the input transistors ITR1, ITR2, and FTR1 through FTRN may be implemented as, for example, a P-channel metal oxide silicon field effect transistor (MOSFET) or a P-channel metal-oxide semiconductor (PMOS) transistor. The source of the current summing transistor ITR1 is electrically coupled to the first voltage supply node 206 and receives the first input voltage VIN1 through the first voltage supply node 206. The current summing transistor ITR1 receives the first bias voltage VB1 from the bias circuit 110 through its gate. The on/off state of the current summing transistor ITR1 depends on the level of the first bias voltage VB1. For instance, when the difference between the first bias voltage VB1 and the first input voltage VIN1 is less than the threshold voltage of the current summing transistor ITR1, the current summing transistor ITR1 is turned on, i.e., it is in the on state. The drain of the current summing transistor ITR1 is electrically coupled with the source of the reference voltage transistor ITR2 and with the sources of the differential input transistors FTR1 through FTRN.

The reference voltage transistor ITR2 receives the reference voltage VREF through its gate. The on/off state of the reference voltage transistor ITR2 depends on the level of the reference voltage VREF. For instance, when the difference between the reference voltage VREF and the source voltage of the reference voltage transistor ITR2 is less than the threshold voltage of the reference voltage transistor ITR2, the reference voltage transistor ITR2 may be turned on, i.e., it is in the on state.

The $i^{th}$ differential input transistor FTRi (where "i" is a natural number equal to or greater than 1 and less than or equal to N) among the differential input transistors FTR1 through FTRN receives the $i^{th}$ feedback voltage VFBi of the feedback voltages VFB1 through VFBN, which has been transmitted through the $i^{th}$ input port 202-*i* of the input ports 202-1 through 202-N, using its gate. The on/off state of the $i^{th}$ differential input transistor FTRi depends on the level of the ith feedback voltage VFBi. For instance, when the difference between the $i^{th}$ feedback voltage VFBi and the source voltage of the $i^{th}$ differential input transistor FTRi is less than the threshold voltage of the $i^{th}$ differential input transistor FTRi, the $i^{th}$ differential input transistor FTRi is turned on, i.e., it is in the on state.

The characteristics of the reference voltage transistor ITR2 may be the same as those of the differential input transistors FTR1 through FTRN. The characteristics of the current summing transistor ITR1 may be the same as or different from those of the reference voltage transistor ITR2 and the $i^{th}$ differential input transistor FTRi.

The magnitude of current transmitted from the differential input circuit 220A to the current summing circuit 240A is different depending on the on/off state of each of the differential input transistors FTR1 through FTRN. In other words, the on/off state of the differential input transistors FTR1 through FTRN is determined according to the level of the feedback voltages VFB1 through VFBN, respectively, and current does not flow in a transistor or transistors FTR1 through FTRN that are in the off state. Accordingly, a first input current I1 is transmitted to a transistor or transistors turned on among the differential input transistors FTR1 through FTRN and the reference voltage transistor ITR2.

Current transmitted to the transistor or transistors turned on among the differential input transistors FTR1 through FTRN may be the same as that transmitted to the reference voltage transistor ITR2. The first input current I1 is transmitted to the current summing circuit 240A through the transistor(s) FTR1 through FTRN that are turned on and through the reference voltage transistor ITR2.

In accordance with an exemplary embodiment, the differential input circuit 220A includes a plurality of unit differential input circuits. The plurality of unit differential input circuits may include one of the plurality of differential input transistors FTR1 through FTRN, and reference voltage transistor ITR2.

That is, a first unit differential input circuit among the plurality of unit differential input circuits may include the first differential input transistor FTR1 and reference voltage transistor ITR2, a second unit differential input circuit among the plurality of unit differential input circuits may include the second differential input transistor FTR2 and reference voltage transistor ITR2, Nth unit differential input circuit among the plurality of unit differential input circuits may include $N^{th}$ differential input transistor FTRN and reference voltage transistor ITR2.

Thus, the plurality of unit differential input circuits may share the reference voltage transistor ITR2.

The current summing circuit 240A receives the first input voltage VIN1 via its connection to the first voltage supply node 206. The first input voltage VIN1 is transmitted to the source of a first reference current transistor RTR1 and to the source of a first mirror current transistor MTR1 included in each of a plurality of mirror current branches 260-1 through 260-N. The magnitude of a second input current I2 that depends on the first input voltage VIN1 may be expressed by Equation 2 as:

$$I2 = I3 - \frac{I1}{M}, \tag{2}$$

where I2 denotes the second input current, I3 denotes a third input current, I1 denotes the first input current, and M denotes the sum of the number of transistors turned on among the differential input transistors FTR1 through FTRN and the reference voltage transistor ITR2. In accordance with this embodiment, the current summing circuit 240A includes a reference current branch 250 and the mirror current branches 260-1 through 260-N. The reference current branch 250 and one mirror current branch 260-*i* may form a single unit current summing circuit. For instance, the reference current branch 250 and the first mirror current branch 260-1 may form a first unit current summing circuit, the reference current branch 250 and the second mirror current branch 260-2 may form a second unit current summing circuit, and the reference current branch 250 and the N-th mirror current branch 260-N may form an N-th unit current summing circuit. Thus, in accordance with this embodiment, the unit current summing circuits share the reference current branch 250. The mirror current branches 260-1 through 260-N may have the same characteristics as one another, and therefore, the unit current summing circuits may have the same characteristics as one another.

The gates of respective reference current transistors RTR1 through RTR4 of the reference current branch 250 are connected to the gates of respective mirror current transistors MTR1 through MTR4 of the mirror current branches 260-1 through 260-N. For instance, the gate of the first reference current transistor RTR1 of the reference current branch 250 is connected to the gate of the first mirror current transistors MTR1 of the mirror current branches 260-1 through 260-N, the gate of the second reference current transistor RTR2 of the reference current branch 250 is connected to the gates of the second mirror current transistors MTR2 of the mirror current branches 260-1 through 260-N, the gate of the third reference current transistor RTR3 of the reference current branch 250 is connected to the gates of the third mirror current transistors MTR3 of the mirror current branches 260-1 through 260-N, and the gate of the fourth reference current transistor RTR4 of the reference current branch 250 is connected to the gates of the fourth mirror current transistors MTR4 of the mirror current branches 260-1 through 260-N.

The magnitude of the first input current I1 may have a fixed value according to the magnitude of the first bias voltage VB1 and the magnitude of the third input current I3 may have a fixed value according to the magnitude of the third bias voltage VB3. Accordingly, the magnitude of the second input current I2 may be determined depending on the number of the differential input transistors FTR1 through FTRN that are tuned on.

The current summing circuit 240A transmits the plurality of intermediate output voltages VIO1 through VION, which are generated by the mirror current branches 260-1 through 260-N, respectively, using the second input current I2, to the buffer circuit 290. For instance, the first mirror current branch 260-1 may transmit the first intermediate output voltage VIO1 generated using the second input current I2 to the first buffer 291-1, the second mirror current branch 260-2 may transmit the second intermediate output voltage VIO2 generated using the second input current I2 to the second buffer 291-2, and the $N^{th}$ mirror current branch 260-N may transmit the $N^{th}$ intermediate output voltage VION generated using the second input current I2 to the $N^{th}$ buffer 291-N. The buffer circuit 290 has a plurality of buffers 291-1 through 291-N that amplify the intermediate output voltages VIO1 through VION, respectively, and output the amplified voltages VAMP1 through VAMPN from the error amplifier 200 to the power transistor circuit 300. The buffers 291-1 through 291-N ensure that the amplified voltages VAMP1-VAMPN have increased driving capacity for driving the power transistors MP1 through MPN, respectively.

In accordance with this embodiment, the error amplifier 200A has a plurality of unit amplifiers. Each of the unit amplifiers includes the current summing transistor ITR1, the reference voltage transistor ITR2, one of the differential input transistors FTR1 through FTRN, the reference current branch 250, one of the mirror current branches 260-1 through 260-N, and one of the plurality of buffers 291-1 through 291-N. In accordance with the embodiment shown in FIG. 3A, the unit amplifiers share the current summing transistor ITR1, the reference voltage transistor ITR2, and the reference current branch 250.

The differential input transistors FTR1 through FTRN may have the same characteristics as one another and the mirror current branches 260-1 through 260-N may have the same characteristics as one another. Accordingly, the unit amplifiers may have the same characteristics as one another.

In accordance with this embodiment, the power transistor circuit 300 has a plurality of the power transistors MP1 through MPN, each of which may be, for example, a P-channel MOSFET. The $i^{th}$ power transistor MPi receives the amplified voltage VAMPi output from buffer 291-*i* at its gate. The on/off state of the $i^{th}$ power transistor MPi depends on the level of the amplified voltage VAMPi received at its gate. The power transistor circuit 300 outputs the output voltages VOUT1 through VOUTN generated according to the operation of the power transistors MP1 through MPN.

In accordance with this embodiment, the feedback network 400 has a plurality of the feedback circuits 410-1 through 410-N. The $i^{th}$ feedback circuit 410-*i* may be implemented as a voltage divider having resistors R1-*i* and R2-*i*. In other words, a divided voltage of the $i^{th}$ voltage divider 410-*i* may be provided for the error amplifier 200A as the $i^{th}$ feedback voltage VFBi. The feedback voltage VFBi is dependent upon the output voltage VOUTi.

In accordance with this embodiment, the voltage regulator 120A-1 comprises a plurality of unit voltage regulators. Each of the unit voltage regulators includes one of the aforementioned unit amplifiers of the error amplifier 200A, one of the power transistors MP1 through MPN of power transistor circuit 300, and one of the feedback circuits 410-1 through 410-N of feedback network 400. In accordance with an embodiment, the unit voltage regulators share the current summing transistor ITR1, the reference voltage transistor ITR2, and the reference current branch 250.

The differential input transistors FTR1 through FTRN may have the same characteristics as one another, the mirror current branches 260-1 through 260-N may have the same characteristics as one another, and the power transistors MP1 through MPN may have the same characteristics as one another. Accordingly, the characteristics of each of the unit voltage regulators may be determined by the characteristics of the feedback circuit.

Figure 3B:
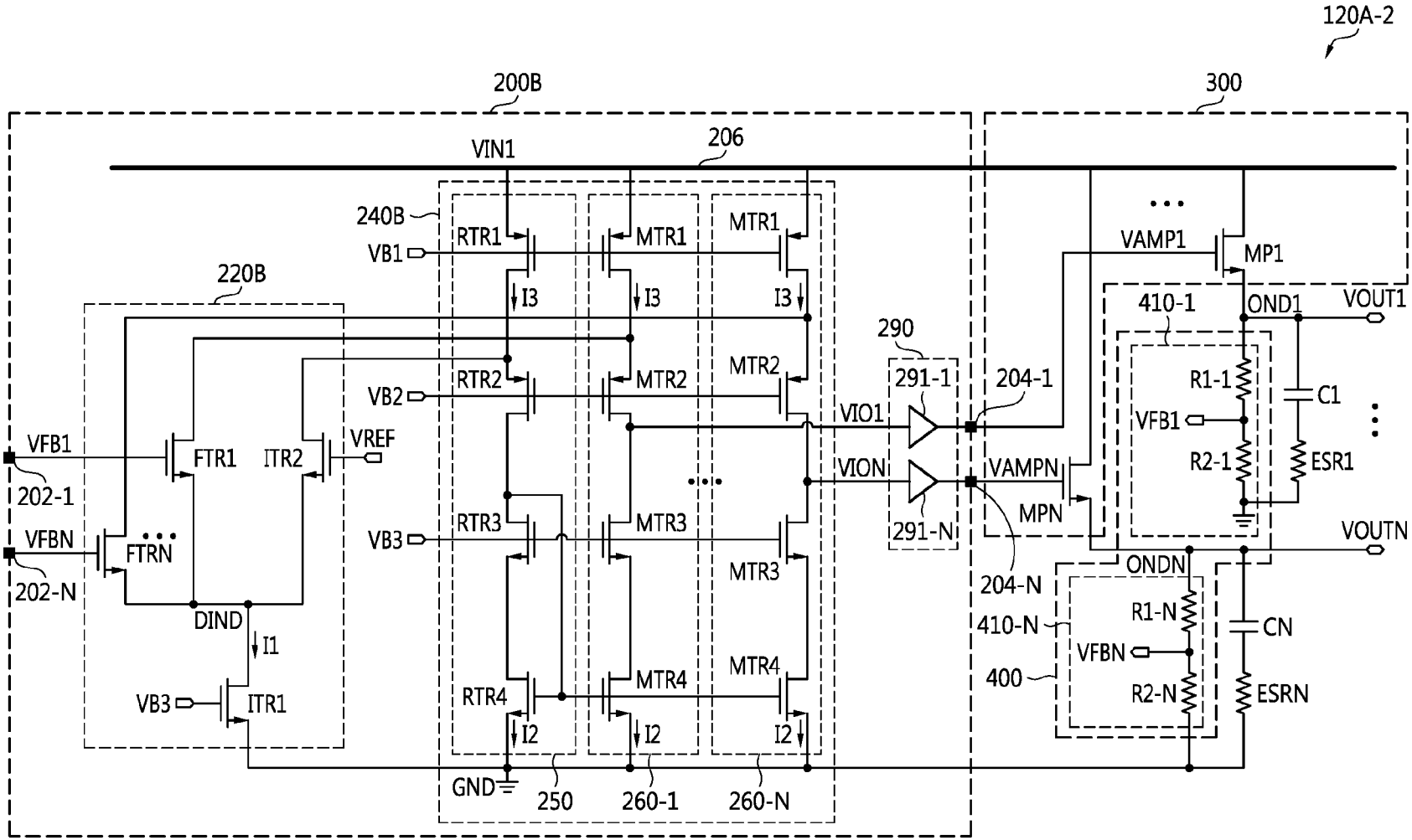
FIG. 3B is a detailed block diagram of the voltage regulator illustrated in FIG. 2 in accordance with an exemplary embodiment.

FIG. 3B is a detailed block diagram of another example 120A-2 of the voltage regulator 120A illustrated in FIG. 2. Referring to FIGS. 1, 2, and 3B, the voltage regulator 120A-2 includes an error amplifier 200B, the power transistor circuit 300, and the feedback network 400. For illustrative purposes, a capacitor Ci and a resistor ESRi are shown connected in series between the ground GND and the output node ONDi of the voltage regulator 120A-2. The power transistor circuit 300 and the feedback network 400 illustrated in FIG. 3B are substantially the same as the power transistor circuit 300 and the feedback network 400, respectively, illustrated in FIG. 3A. Thus, the description of the power transistor circuit 300 and the feedback network 400 will be omitted.

In accordance with this exemplary embodiment, the error amplifier 200B includes a differential input circuit 220B, a current summing circuit 240B, and the buffer circuit 290. The error amplifier 200B controls the gate of the power transistors MP1 through MPN of the power transistor circuit 300 using the first input voltage VIN1 and the ground voltage GND as operating voltages. The error amplifier 200B uses the first input voltage VIN1 supplied through the first voltage supply node 206 and the ground voltage GND supplied through the ground GND as the operating voltages, amplifies the difference between the reference voltage VREF and each of the feedback voltages VFB1 through VFBN, and outputs the plurality of the amplified voltages VAMP1 through VAMPN as the result of amplification.

In accordance with this embodiment, the differential input circuit 220B includes the current summing transistor ITR1, the reference voltage transistor ITR2, and a plurality of the differential input transistors FTR1 through FTRN. In various embodiments, the number of the differential input transistors FTR1 through FTRN that are used in the differential input circuit 220B changes.

In accordance with this embodiment, the current summing transistor ITR1, the reference voltage transistor ITR2, and the differential input transistors FTR1 through FTRN are implemented as N-channel MOSFET or NMOS transistors. The source of the current summing transistor ITR1 is electrically coupled with the ground GND. The current summing transistor ITR1 receives, at its gate, the third bias voltage VB3 from the bias circuit 110. The on/off state of the current summing transistor ITR1 depends on the level of the third bias voltage VB3. For instance, when the difference between the third bias voltage VB3 and the ground voltage GND is greater than the threshold voltage of the current summing transistor ITR1, the current summing transistor ITR1 is turned on, i.e., it is in the on state. The drain of the current summing transistor ITR1 is electrically coupled with the source of the reference voltage transistor ITR2 and with the source of each of the differential input transistors FTR1 through FTRN.

The reference voltage transistor ITR2 receives the reference voltage VREF at its gate. The on/off state of the reference voltage transistor ITR2 depends on the level of the reference voltage VREF. For instance, when the difference between the reference voltage VREF and the source voltage of the reference voltage transistor ITR2 is greater than the threshold voltage of the reference voltage transistor ITR2, the reference voltage transistor ITR2 is turned on.

The $i^{th}$ differential input transistor FTRi of the differential input transistors FTR1 through FTRN receives, at its gate, the $i^{th}$ feedback voltage VFBi of the feedback voltages VFB1 through VFBN, which is transmitted through the $i^{th}$ input port 202-*i* of the input ports 202-1 through 202-N. The on/off state of the $i^{th}$ differential input transistor FTRi depends on the level of the $i^{th}$ feedback voltage VFBi. For instance, when the difference between the $i^{th}$ feedback voltage VFBi and the source voltage of the $i^{th}$ differential input transistor FTRi is greater than the threshold voltage of the $i^{th}$ differential input transistor FTRi, the $i^{th}$ differential input transistor FTRi is turned on.

The characteristics of the reference voltage transistor ITR2 may be the same as those of the differential input transistors FTR1 through FTRN. The characteristics of the current summing transistor ITR1 may be the same as or different from those of the reference voltage transistor ITR2 and the differential input transistors FTR1 through FTRN.

The magnitude of current transmitted from the differential input circuit 220B to the current summing circuit 240B will depend on the on/off state of each of the differential input transistors FTR1 through FTRN. In other words, the on/off state of the differential input transistors FTR1 through FTRN is determined according to the level of the feedback voltages VFB1 through VFBN and whether current is flowing in one or more of the differential input transistors FTR1 through FTRN. Accordingly, the current summing transistor ITR1 receives the first input current I1 flowing through the differential input transistors FTR1 through FTRN that are turned on and through the reference voltage transistor ITR2. Current received from the differential input transistors FTR1 through FTRN that are turned on may be the same as that received from the reference voltage transistor ITR2. The current summing transistor ITR1 transmits the first input current I1 to the current summing circuit 240B in response to the third bias voltage VB3 applied to its gate.

In accordance with an embodiment, the differential input circuit 220B includes a plurality of unit differential input circuits, each of which includes one of the plurality of differential input transistors FTR1 through FTRN, and the reference voltage transistor ITR2. That is, a first one of the unit differential input circuits includes the first differential input transistor FTR1 and the reference voltage transistor ITR2, a second one of the unit differential input circuits includes the second differential input transistor FTR2 and the reference voltage transistor ITR2, and an $N^{th}$ one of the unit differential input circuits includes the $N^{th}$ differential input transistor FTRN and the reference voltage transistor ITR2. Thus, the plurality of unit differential input circuits share the reference voltage transistor ITR2.

The current summing circuit 240B receives the first input voltage VIN1 via its connection to the first voltage supply node 206. The first input voltage VIN1 is transmitted to the source of the first reference current transistor RTR1 and to the source of the first mirror current transistors MTR1 of the mirror current branches 260-1 through 260-N. The magnitude of the second input current I2 depends on the first input voltage VIN1 as expressed in Equation 3 as:

$$I2 = I3 - \frac{I1}{L}, \tag{3}$$

where I2 denotes the second input current, I3 denotes a third input current, I1 denotes the first input current, and L denotes the sum of the number of the differential input transistors FTR1 through FTRN that are turned on and the turned-on reference voltage transistor ITR2.

In accordance with this embodiment, the current summing circuit 240B includes the reference current branch 250 and the mirror current branches 260-1 through 260-N. The reference current branch 250 and one of the mirror current branches 260-*i* comprise a single unit current summing circuit. For instance, the reference current branch 250 and the first mirror current branch 260-1 comprise a first unit current summing circuit, the reference current branch 250 and the second mirror current branch 260-2 comprise a second unit current summing circuit, and the reference current branch 250 and the $N^{th}$ mirror current branch 260-N comprise an $N^{th}$ unit current summing circuit. The mirror current branches 260-1 through 260-N may have the same characteristics, and therefore the unit current summing circuits may have the same characteristics.

The gates of the respective reference current transistors RTR1 through RTR4 included in the reference current branch 250 are connected with the gates of respective mirror current transistors MTR1 through MTR4 of the mirror current branches 260-1 through 260-N. For instance, the gate of the first reference current transistor RTR1 of the reference current branch 250 is connected with the first mirror current transistors MTR1 of the mirror current branches 260-1 through 260-N, the gate of the second reference current transistor RTR2 of the reference current branch 250 is connected with the second mirror current transistors MTR2 of the mirror current branches 260-1 through 260-N, the gate of the third reference current transistor RTR3 of the reference current branch 250 is connected with the third mirror current transistors MTR3 of the mirror current branches 260-1 through 260-N, and the gate of the fourth reference current transistor RTR4 of the reference current branch 250 is connected with the fourth mirror current transistors MTR4 of the mirror current branches 260-1 through 260-N.

The magnitude of the first input current I1 may have a fixed value that depends on the magnitude of the third bias voltage VB3 and the magnitude of the third input current I3 may have a fixed value that depends on the magnitude of the first bias voltage VB1.

The current summing circuit 240B transmits the plurality of intermediate output voltages VIO1 through VION, which are generated by the mirror current branches 260-1 through 260-N using the second input current I2, to the buffer circuit 290. For instance, the first mirror current branch 260-1 transmits the first intermediate output voltage VIO1 generated using the second input current I2 to the first buffer 291-1, the second mirror current branch 260-2 transmits the second intermediate output voltage VIO2 generated using the second input current I2 to the second buffer 291-2, and the $N^{th}$ mirror current branch 260-N transmits the $N^{th}$ intermediate output voltage VION generated using the second input current I2 to the $N^{th}$ buffer 291-N.

The buffer circuit 290 includes a plurality of buffers 291-1 through 291-N that amplify the intermediate output voltages VIO1 through VION to produce the amplified voltages VAMP1 through VAMPN, respectively, which are output from the error amplifier 200. The amplified voltages VAMP1 through VAMPN have increased driving capacity for driving the gates of the power transistors MP1 through MPN of the power transistor circuit 300. Thus, the buffers 291-1 through 291-N provide increased driving capacity for driving the power transistor circuit 300.

In accordance with an embodiment, the error amplifier 200B includes a plurality of unit amplifiers, each of which includes the current summing transistor ITR1, the reference voltage transistor ITR2, one of the differential input transistors FTR1 through FTRN, the reference current branch 250, one of the mirror current branches 260-1 through 260-N, and one of the plurality of buffers 291-1 through 291-N. Thus, the unit amplifiers share the current summing transistor ITR1, the reference voltage transistor ITR2, and the reference current branch 250.

The differential input transistors FTR1 through FTRN may have the same characteristics and the mirror current branches 260-1 through 260-N may have the same characteristics. Accordingly, the unit amplifiers may have the same characteristics.

In accordance with an embodiment, the voltage regulator 120A-2 includes a plurality of unit voltage regulators. Each of the unit voltage regulators includes one of the unit amplifiers of the error amplifier 200B, one of the power transistors MP1 through MPN of the power transistor circuit 300, and one of the feedback circuits 410-1 through 410-N of the feedback network 400. In accordance with an embodiment, the unit voltage regulators share the current summing transistor ITR1, the reference voltage transistor ITR2, and the reference current branch 250.

The differential input transistors FTR1 through FTRN may have the same characteristics, the mirror current branches 260-1 through 260-N may have the same characteristics, and the power transistors MP1 through MPN may have the same characteristics. Accordingly, the characteristics of each of the unit voltage regulators may be determined by the characteristics of the feedback circuit.

Figure 4:
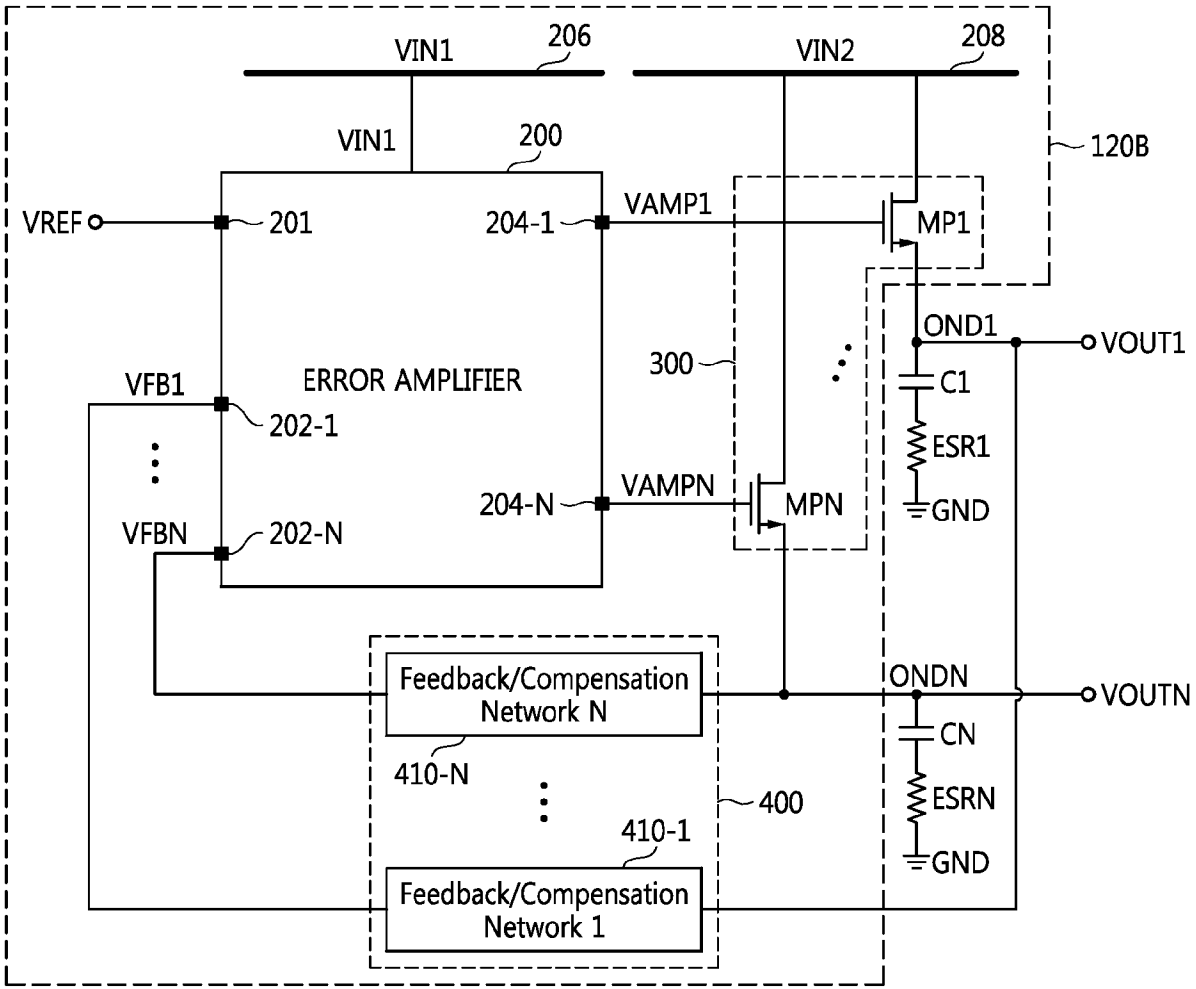
FIG. 4 is a block diagram of the voltage regulator illustrated in FIG. 1 in accordance with an exemplary embodiment.
Figure 5A:
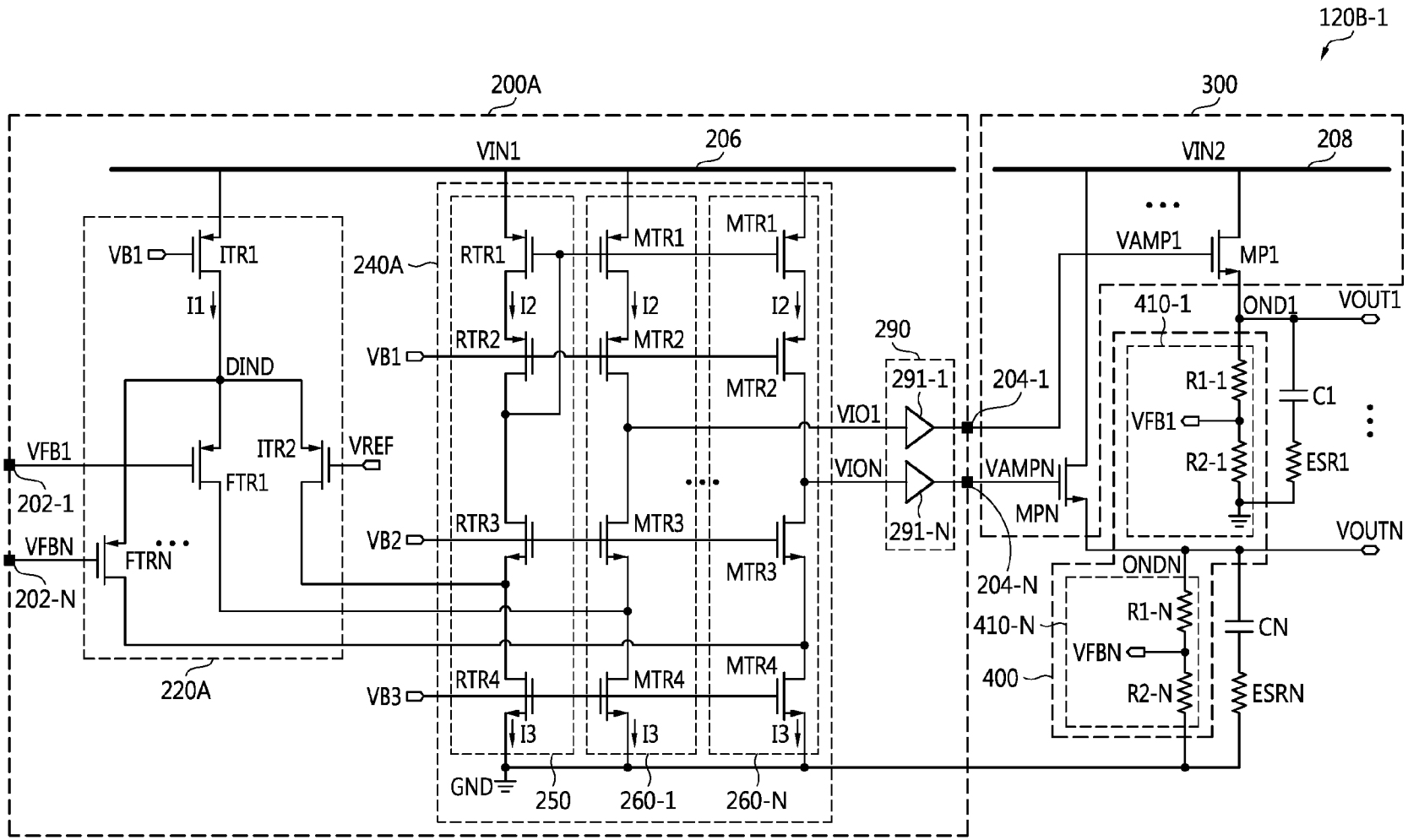
FIG. 5A is a detailed block diagram of the voltage regulator illustrated in FIG. 4 in accordance with an exemplary embodiment.
Figure 5B:
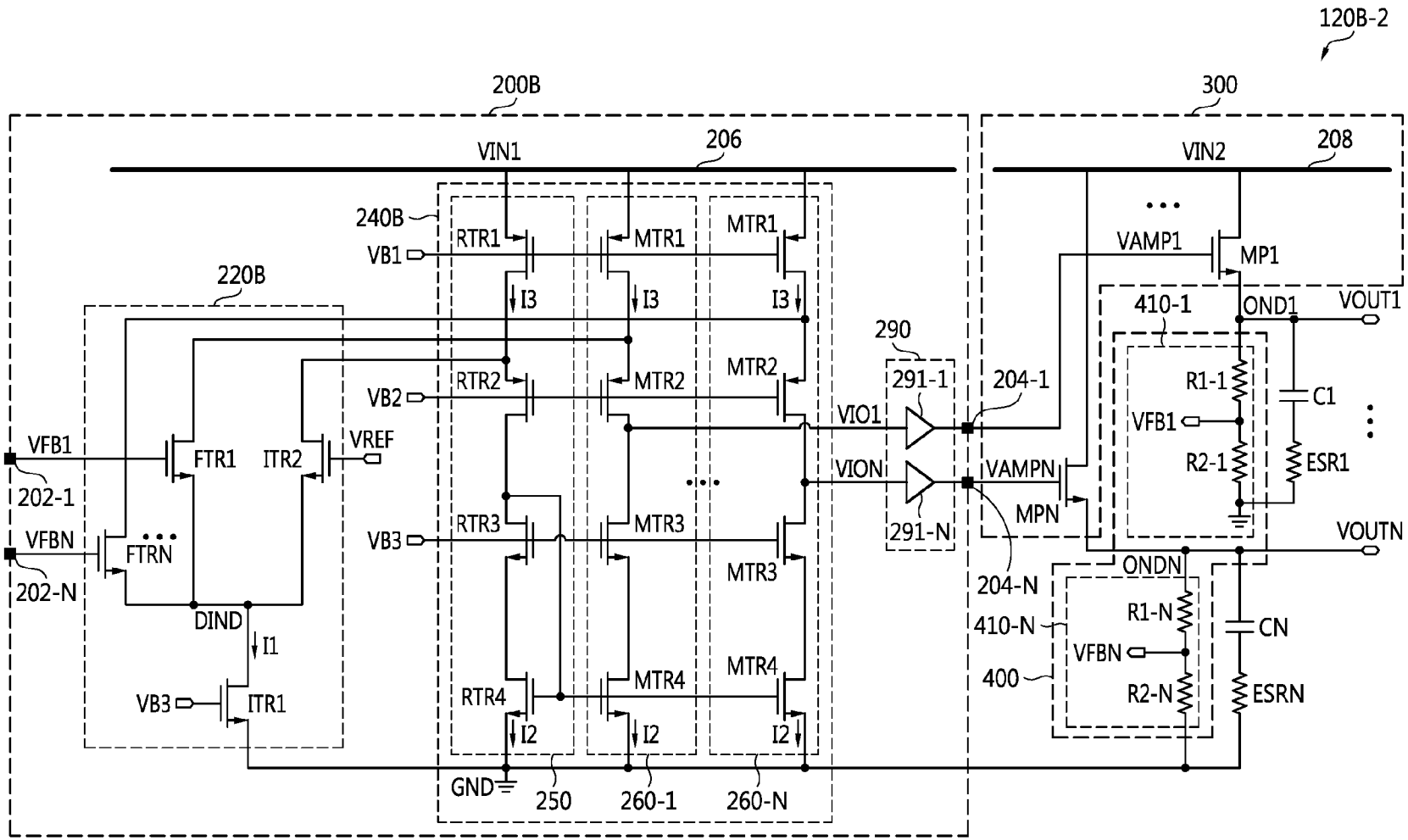
FIG. 5B is a detailed block diagram of the voltage regulator illustrated in FIG. 4 in accordance with an exemplary embodiment.

FIG. 4 is a block diagram of another example 120B of the voltage regulator 120 illustrated in FIG. 1. FIGS. 5A and 5B are detailed block diagrams of examples 120B-1 and 120B-2 of the voltage regulator 120B illustrated in FIG. 4. Referring to FIGS. 1 through 5A, the functions and features of the error amplifier 200A and the feedback network 400 illustrated in FIGS. 4 and 5A may be the same as those of the error amplifier 200A and the feedback network 400 illustrated in FIGS. 2 and 3A. Thus, the descriptions of the error amplifier 200A and the feedback network 400 illustrated in FIGS. 4 and 5A will be omitted here.

Referring to FIGS. 1, 2, 4, and 5A, the power transistor circuit 300 is connected between a second voltage supply node 208 and the output ports 204-1 through 204-N of the error amplifier 200A. The power transistor circuit 300 controls the levels of the output voltages VOUT1 through VOUTN and/or whether to output the output voltages VOUT1 through VOUTN based on the plurality of amplified voltages VAMP1 through VAMPN of the error amplifier 200 that are applied to the gates of the power transistors MP1 through MPN, respectively. In accordance with this embodiment, the power transistor circuit 300 uses, as an operating voltage, the second input voltage VIN2 supplied through the second voltage supply node 208. The $i^{th}$ output voltage VOUTi output from the power transistor circuit 300 may be determined by Equation 1 depending on the reference voltage VREF and the output resistors R1-*i* and R2-*i* connected to the $i^{th}$ output node ONDi, as described above with reference to FIG. 2. The power transistor circuit 300 includes the plurality of the power transistors MP1 through MPN. Each of the power transistors MP1 through MPN may be implemented as an NMOS transistor.

The $i^{th}$ power transistor MPi receives the $i^{th}$ amplified voltage VAMPi at its gate. The power transistor MPi is turned on or off according to the level of the amplified voltage VAMPi. The power transistor circuit 300 outputs the output voltages VOUT1 through VOUTN by the operations of the power transistors MP1 through MPN.

Referring to FIGS. 1 through 5B, the functions and features of the error amplifier 200B and the feedback network 400 illustrated in FIGS. 4 and 5B may be the same as those of the error amplifier 200B and the feedback network 400, respectively, illustrated in FIGS. 2 and 3B and the functions and features of the power transistor circuit 300 illustrated in FIGS. 4 and 5B may be the same as those of the power transistor circuit 300 illustrated in FIG. 5A. Thus, the descriptions of the error amplifier 200B, the power transistor circuit 300, and the feedback network 400 illustrated in FIGS. 4 and 5B will be omitted here.

In accordance with an embodiment, the voltage regulator 120B-1 or 120B-2 illustrated in FIG. 5A or 5B include a plurality of unit voltage regulators. Each of the unit voltage regulators includes one of the unit amplifiers of the error amplifier 200A or 200B, one of the power transistors MP1 through MPN, and one of the feedback circuits 410-1 through 410-N. In accordance with this embodiment, the unit voltage regulators share the current summing transistor ITR1, the reference voltage transistor ITR2, and the reference current branch 250 with one another.

The differential input transistors FTR1 through FTRN may have the same characteristics, the mirror current branches 260-1 through 260-N may have the same characteristics, and the power transistors MP1 through MPN may have the same characteristics. Accordingly, the characteristics of each of the unit voltage regulators may be determined by the characteristics of the feedback circuit.

Figure 6:
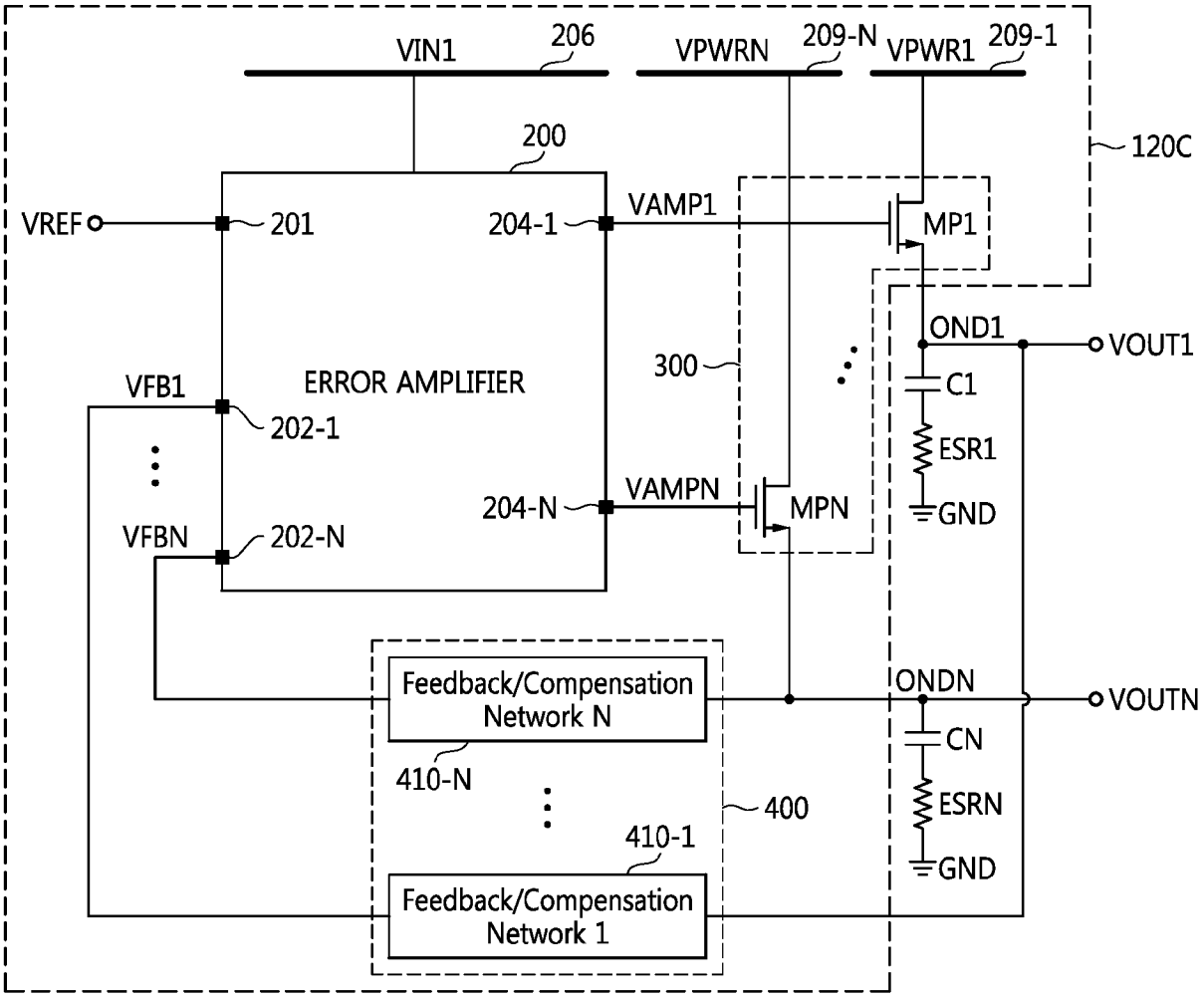
FIG. 6 is a block diagram of the voltage regulator illustrated in FIG. 1 in accordance with an exemplary embodiment.
Figure 7A:
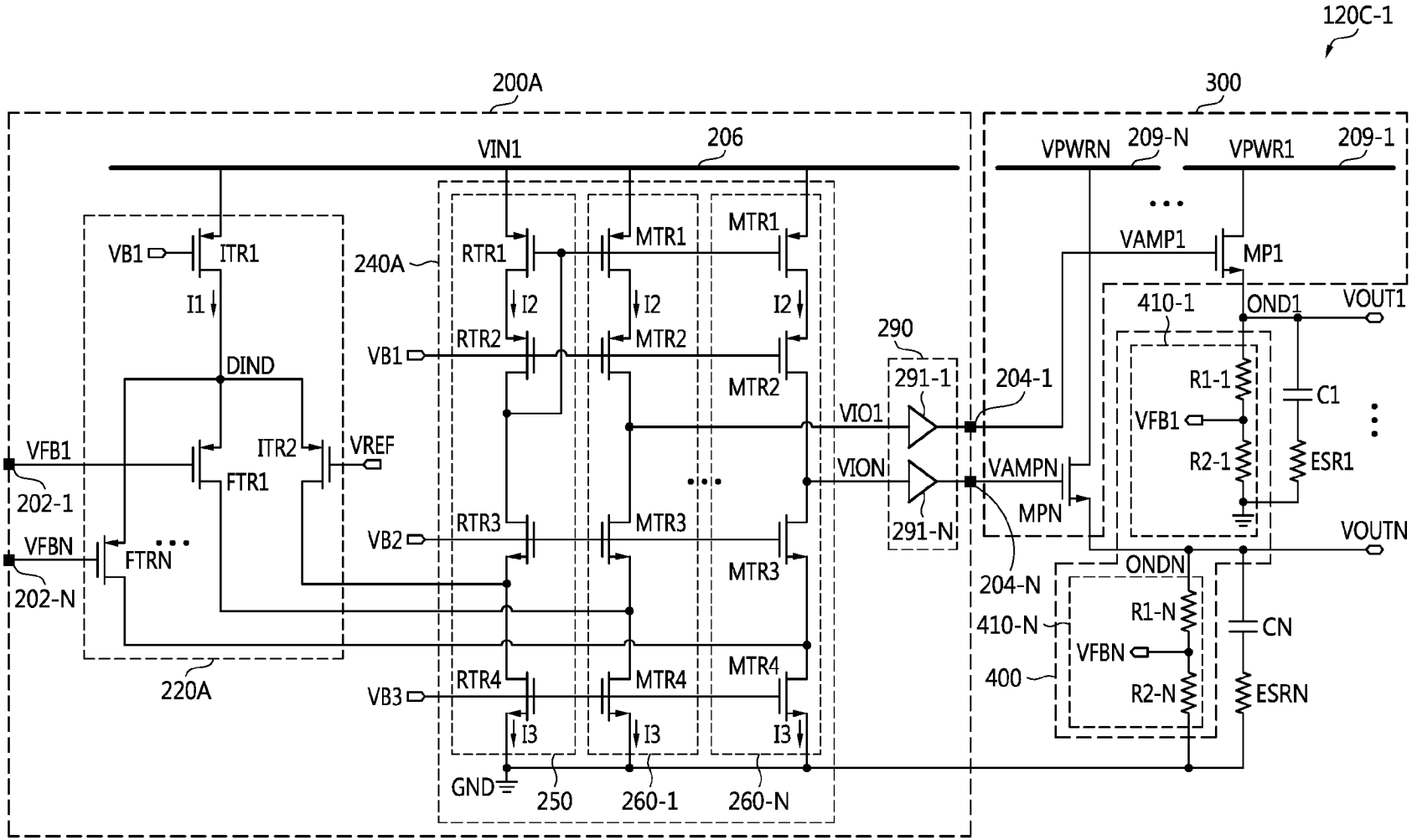
FIG. 7A is a detailed block diagram of the voltage regulator illustrated in FIG. 6 in accordance with an exemplary embodiment.
Figure 7B:
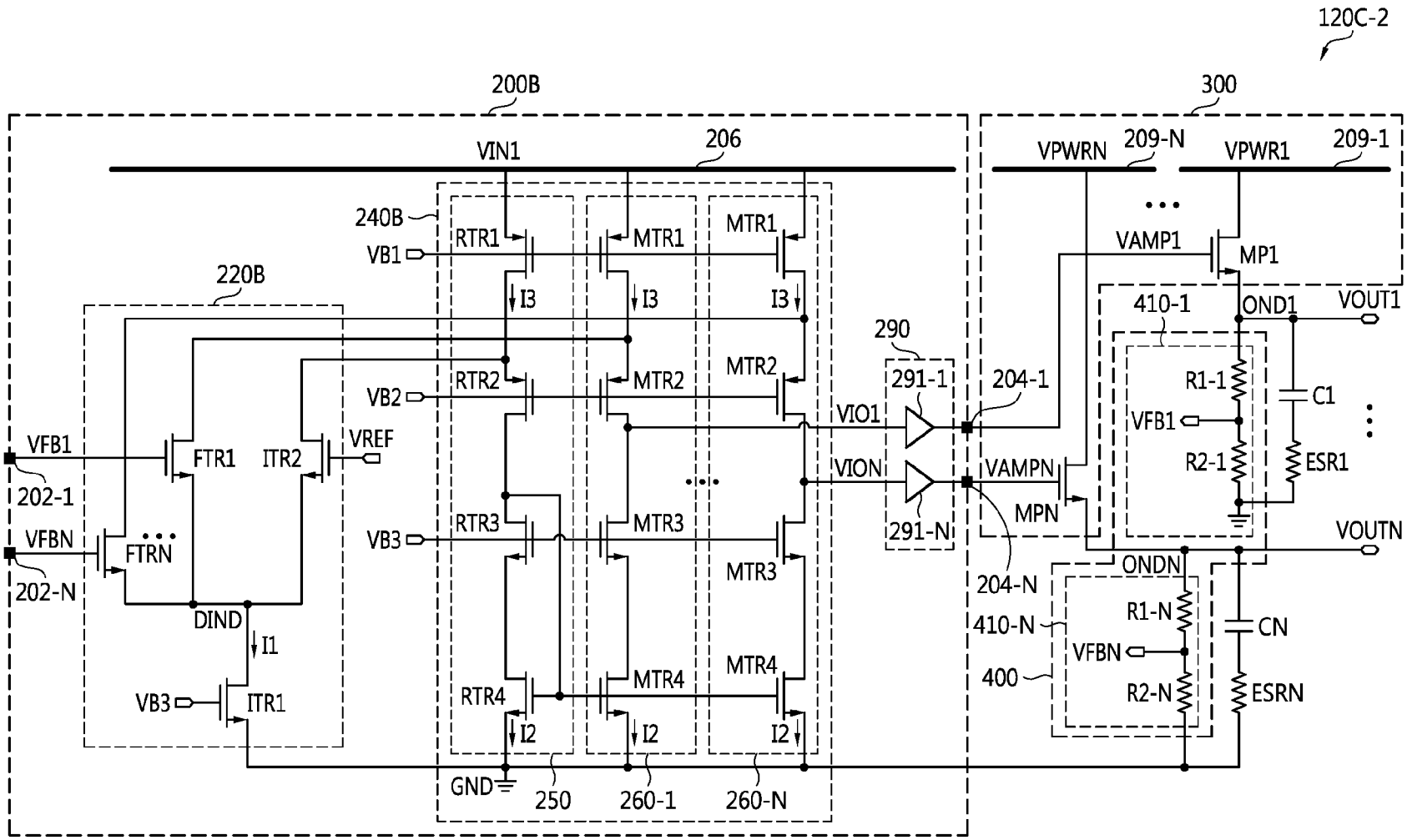
FIG. 7B is a detailed block diagram of the voltage regulator illustrated in FIG. 6 in accordance with an exemplary embodiment.

FIG. 6 is a block diagram of yet another example 120C of the voltage regulator 120 illustrated in FIG. 1. FIGS. 7A and 7B are detailed block diagrams of examples 120C-1 and 120C-2 of the voltage regulator 120C illustrated in FIG. 6. Referring to FIGS. 1 through 7A, the functions and features of the error amplifier 200A and the feedback network 400 illustrated in FIGS. 6 and 7A may be the same as those of the error amplifier 200A and the feedback network 400 illustrated in FIGS. 2, 3A, 4, and 5A. Thus, the descriptions of the error amplifier 200A and the feedback network 400 illustrated in FIGS. 6 and 7A will be omitted here.

Referring to FIGS. 1, 2, 6, and 7A, the power transistor circuit 300 is electrically coupled between a plurality of driving voltage nodes 209-1 through 209-N and output ports 204-1 through 204-N of the error amplifier 200. The power transistor circuit 300 controls the level of the output voltages VOUT1 through VOUTN and/or whether to output the output voltages VOUT1 through VOUTN based on the plurality of the amplified voltages VAMP1 through VAMPN of the error amplifier 200 applied to the gates of the power transistors MP1 through MPN, respectively. For instance, the $i^{th}$ power transistor MPi of the power transistor circuit 300 receives an $i^{th}$ driving voltage VPWRi from the ith driving voltage node 209-*i* and uses the ith driving voltage VPWRi as an operating voltage.

The $i^{th}$ output voltage VOUTi output from the power transistor circuit 300 is determined in accordance with Equation 1 based on the reference voltage VREF and the output resistors R1-*i* and R2-*i* connected to the output node ONDi, as described above with reference to FIG. 2. The power transistor circuit 300 has a plurality power transistors MP1 through MPN. Each of the power transistors MP1 through MPN may be implemented as an NMOS transistor.

The $i^{th}$ power transistor MPi receives the $i^{th}$ amplified voltage VAMPi at its gate. The power transistor MPi is turned on or off according to the level of the amplified voltage VAMPi. The power transistor circuit 300 outputs the output voltages VOUT1 through VOUTN generated through the operations of the power transistors MP1 through MPN.

Referring to FIGS. 1 through 7B, the functions and features of the error amplifier 200B and the feedback network 400 illustrated in FIGS. 6 and 7B may be the same as those of the error amplifier 200B and the feedback network 400, respectively, illustrated in FIGS. 2, 3B, 4, and 5B. Likewise, the functions and features of the power transistor circuit 300 illustrated in FIGS. 6 and 7B may be the same as those of the power transistor circuit 300 illustrated in FIG. 7A. Thus, the descriptions of the error amplifier 200B, the power transistor circuit 300, and the feedback network 400 illustrated in FIGS. 6 and 7B are omitted.

The voltage regulator 120C-1 or 120C-2 illustrated in FIG. 7A or 7B, respectively, include a plurality of unit voltage regulators, each of which includes one of the unit amplifiers of the error amplifier 200A or 200B, one of the power transistors MP1 through MPN, and one of the feedback circuits 410-1 through 410-N. In accordance with this embodiment, the unit voltage regulators share the current summing transistor ITR1, the reference voltage transistor ITR2, and the reference current branch 250.

The differential input transistors FTR1 through FTRN may have the same characteristics as one another, the mirror current branches 260-1 through 260-N may have the same characteristics as one another, and the power transistors MP1 through MPN may have the same characteristics as one another. Accordingly, the characteristics of each of the unit voltage regulators are determined by the characteristics of the feedback circuit.

Figure 8:
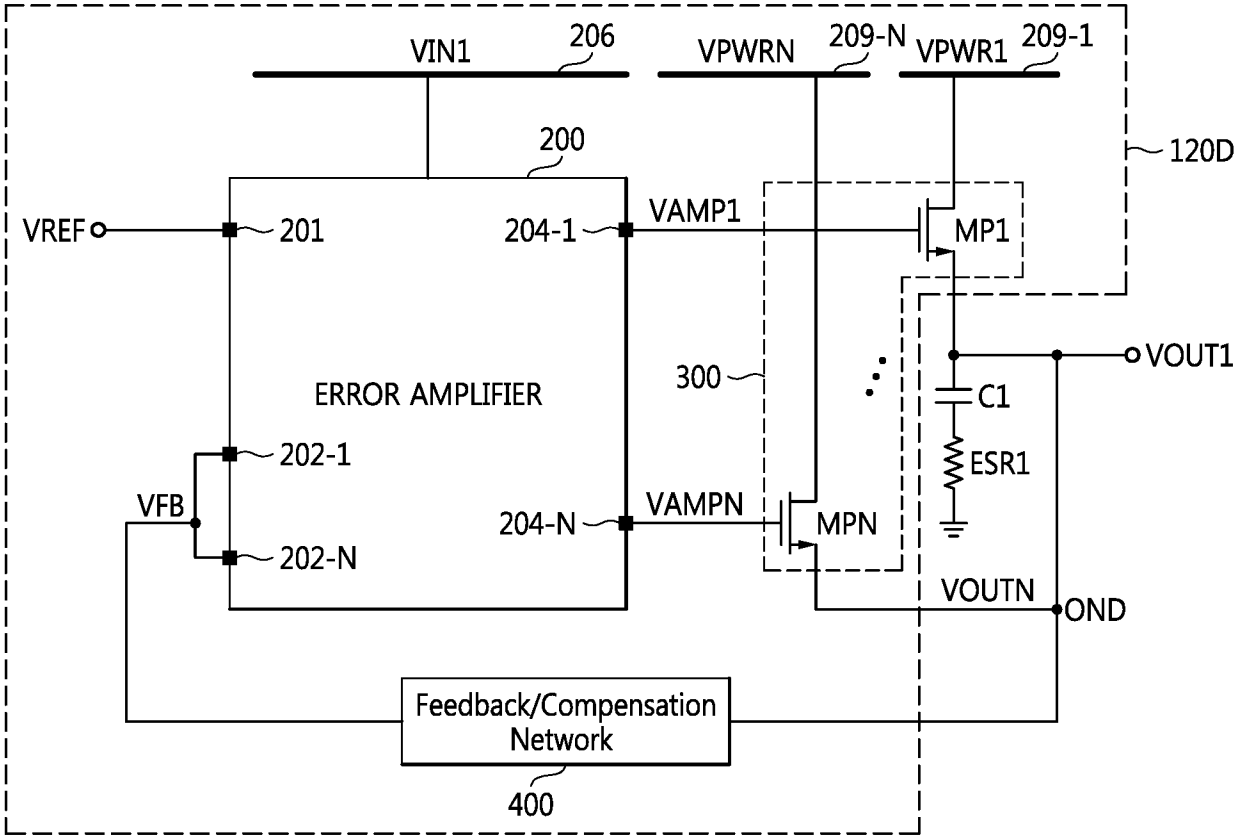
FIG. 8 is a block diagram of the voltage regulator illustrated in FIG. 1 in accordance with an exemplary embodiment.
Figure 9A:
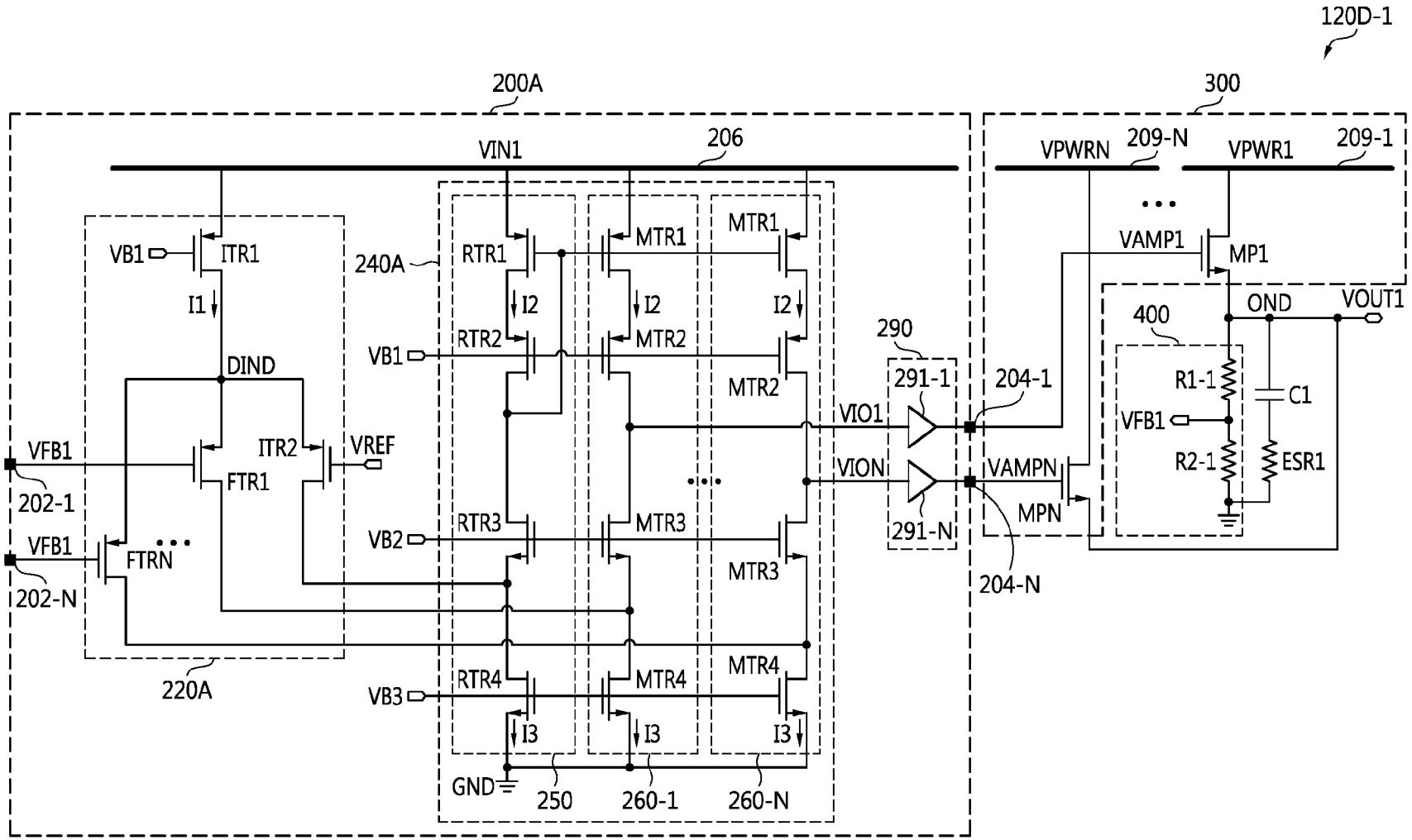
FIG. 9A is a detailed block diagram of the voltage regulator illustrated in FIG. 8 in accordance with an exemplary embodiment.
Figure 9B:
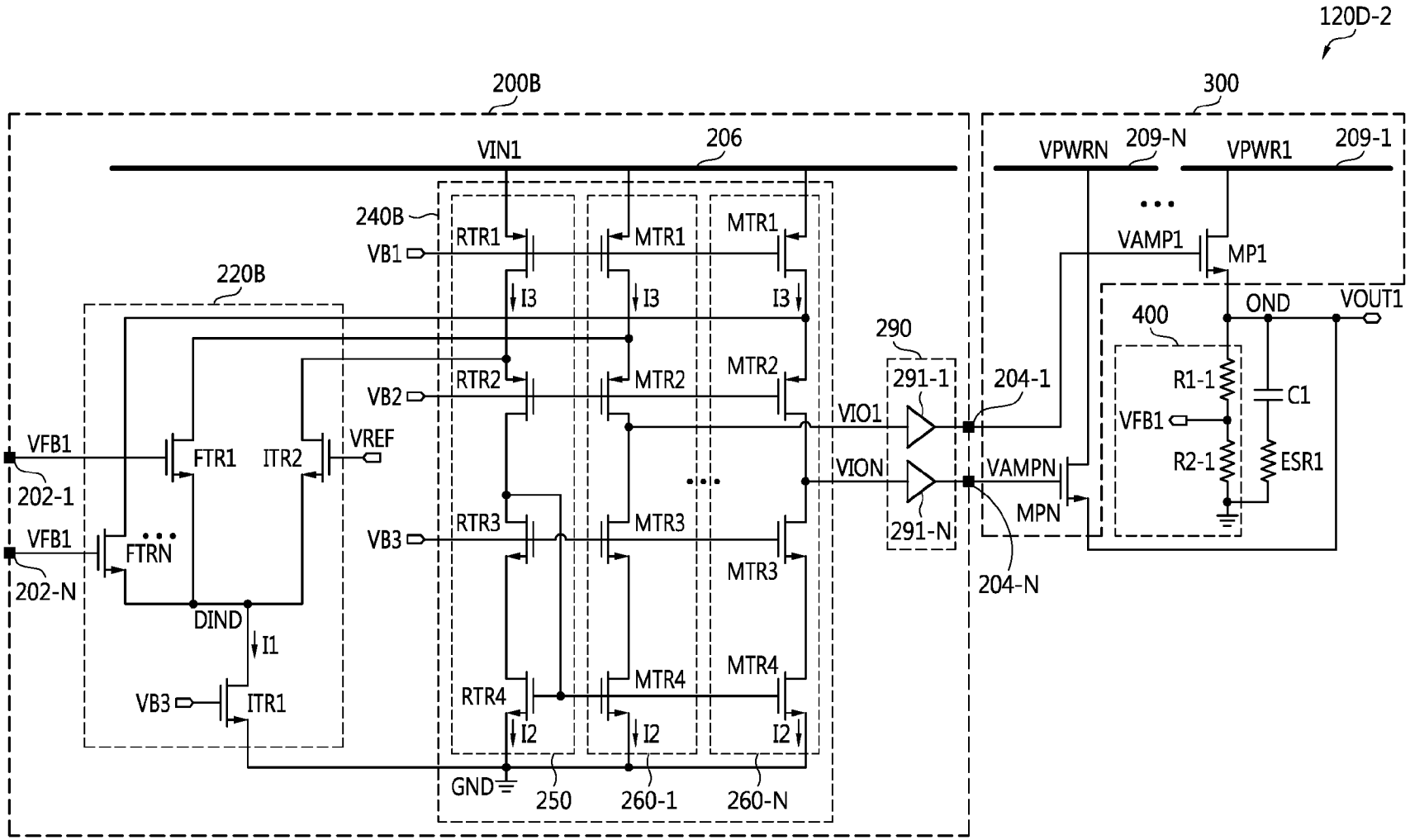
FIG. 9B is a detailed block diagram of the voltage regulator illustrated in FIG. 8 in accordance with an exemplary embodiment.

FIG. 8 is a block diagram of yet another example 120D of the voltage regulator 120 illustrated in FIG. 1. FIGS. 9A and 9B are detailed block diagrams of examples 120D-1 and 120D-2 of the voltage regulator 120D illustrated in FIG. 8. Referring to FIGS. 1 through 9A, the functions and features of the error amplifier 200A and the power transistor circuit 300 illustrated in FIGS. 8 and 9A may be the same as those of the error amplifier 200A and the power transistor circuit 300, respectively, illustrated in FIGS. 6 and 7A. Thus, the descriptions of the error amplifier 200A and the power transistor circuit 300 illustrated in FIGS. 8 and 9A are omitted.

Referring to FIGS. 1, 2, 8, and 9A, in accordance with this embodiment, the sources of the power transistors MP1 through MPN are connected with one another. Accordingly, the power transistors MP1 through MPN share one capacitor C1 and one resistor ESR1 and the power transistor circuit 300 has a single output voltage VOUT1. The feedback network 400 has a single feedback circuit, which can have the configuration shown in FIG. 9A. The feedback network 400 is connected to output node OND and receives the output voltage VOUT1 output by the power transistor circuit 300. The feedback network 400 is also connected to the input ports 202-1 through 202-N of the error amplifier 200A for providing a feedback voltage VFB to the error amplifier 200 based on the output voltage VOUT1 of the output node OND.

Referring to FIGS. 1 through 9B, the functions and features of the error amplifier 200B and the power transistor circuit 300 illustrated in FIGS. 8 and 9B may be the same as those of the error amplifier 200B and the power transistor circuit 300, respectively, illustrated in FIGS. 6 and 7B. Likewise, the functions and features of the capacitor C1, the resistor ESR1, and the feedback network 400 illustrated in FIGS. 8 and 9B may be the same as those of the capacitor C1, the resistor ESR1, and the feedback network 400, respectively, illustrated in FIG. 9A. Thus, the descriptions of the error amplifier 200B, the power transistor circuit 300, the feedback network 400, the capacitor C1, and the resistor ESR1 illustrated in FIGS. 8 and 9B are omitted.

The voltage regulator 120D-1 or 120D-2 illustrated in FIG. 9A or 9B, respectively, include a plurality of unit voltage regulators, each of which includes one of the unit amplifiers of the error amplifier 200A or 200B, one of the power transistors MP1 through MPN, and the feedback network 400. In accordance with this embodiment, the unit voltage regulators share the current summing transistor ITR1, the reference voltage transistor ITR2, the reference current branch 250, and the feedback network 400.

The differential input transistors FTR1 through FTRN may have the same characteristics, the mirror current branches 260-1 through 260-N may have the same characteristics, and the power transistors MP1 through MPN may have the same characteristics. Accordingly, the unit voltage regulators may have the same characteristics.

Figure 10:
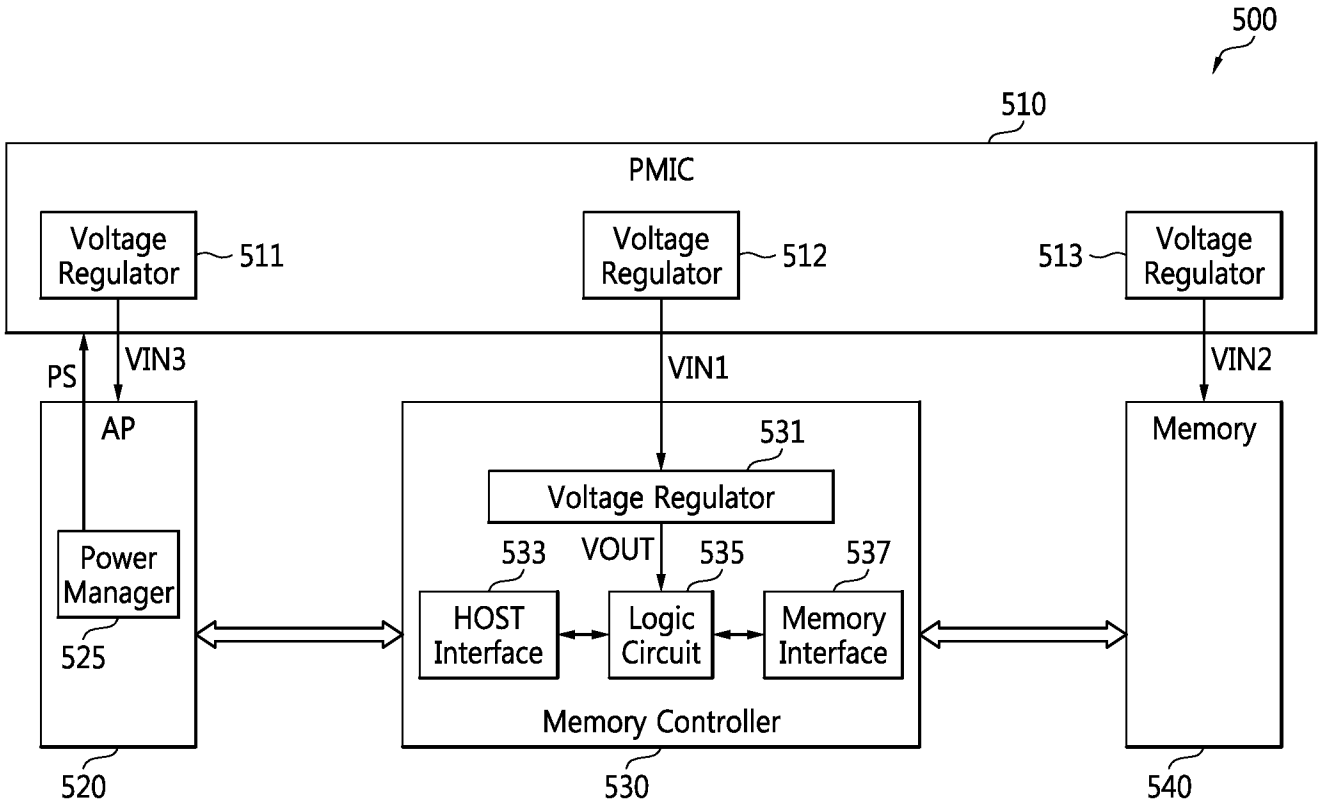
FIG. 10 is a block diagram of a mobile device in accordance with an exemplary embodiment that incorporates the voltage regulator illustrated in FIG. 1.

FIG. 10 is a block diagram of a mobile device 500 in accordance with an exemplary embodiment that includes three voltage regulators 511, 512 and 513 that may have any of the configurations described above with reference to FIGS. 1-9B. Referring to FIGS. 1 through 10, the mobile device 500 includes a power management IC (PMIC) 510, an application processor (AP) 520, a memory controller 530, and a memory 540. The mobile device 500 may be implemented as, for example, but is not limited to, a laptop computer, a cellular phone, a smart phone, a tablet personal computer (PC), a personal digital assistant (PDA), an enterprise digital assistant (EDA), a digital still camera, a digital video camera, a portable multimedia player (PMP), a personal navigation device or portable navigation device (PND), a handheld game console, a mobile internet device (MID), a wearable computer, an internet of things (IoT) device, an internet of everything (IoE) device, a drone, or an e-book.

The PMIC 510 supplies power to the components 520, 530, and 540 under the control of the AP 520. The voltage regulators 511, 512, and 513 are incorporated into the PMIC 510 and generate voltages VIN3, VIN1, and VIN2, respectively. Each of the voltage regulators 511, 512, and 513 may be an LDO voltage regulator or a switching voltage regulator (e.g., a buck converter). Each of the voltage regulators 511, 512, and 513 may be one of the voltage regulators 120A through 120D described with reference to FIGS. 1 through 9B.

Although a respective voltage VIN1, VIN2, or VIN3 is supplied to a respective function block 530, 540, or 520 by a respective voltage regulator 512, 513, or 511 in the embodiment illustrated in FIG. 10, the inventive concept is not restricted to this arrangement. For example, in other embodiments, the PMIC 510 supply a voltage to at least two of the function blocks 520 through 540 using one voltage regulator 511, 512, or 513.

In accordance with the embodiment shown in FIG. 10, the first voltage regulator 511 generates the third voltage VIN3 to be supplied to the AP 520, the second voltage regulator 512 generates the first voltage VIN1 to be supplied to the memory controller 530 and the third voltage regulator 513 generates the second voltage VIN2 to be supplied to the memory 540. The AP 520 receives the third voltage VIN3 from the PMIC 510 and controls the overall operation of the memory controller 530 using the third voltage VIN3 as operating power. The AP 520 may also control read/write operations performed by the memory 540 via the memory controller 530. The AP 520 includes a power manager 525 for controlling the operations of the PMIC 510.

The power manager 525 turns on or off a signal or voltage PS output to the PMIC 510 under the control of the AP 520 to perform power management of the mobile device 500. In accordance with this exemplary embodiment, the memory controller 530 uses the single power VIN1 and includes a voltage regulator 531, a host interface 533, a logic circuit 535, and a memory interface 537.

The voltage regulator 531 may be one of the voltage regulators 120A through 120D described with reference to FIGS. 1 through 9B. The voltage regulator 531 supplies an output voltage VOUT to the logic circuit 535. Although the output voltage VOUT is supplied to the logic circuit 535 in the embodiment illustrated in FIG. 10, in other embodiments the output voltage VOUT may be supplied to the host interface 533 and/or to the memory interface 537.

The host interface 533 acts as an interface between the AP 520 and the logic circuit 535. The memory interface 537 acts as an interface between the logic circuit 535 and the memory 540. The memory interface 537 may be a memory controller interface.

The AP 520, using the third voltage VIN3, controls the operation of the memory controller 530 and communicates signals via the host interface 533 with the memory controller 530. The memory controller 530 controls the operations, e.g., the write and read operations, of the memory 540 according to the control of the AP 520 and communicates data with the memory 540. The memory 540, which uses the second voltage VIN2, may be volatile or non-volatile memory. The volatile memory may be, for example, random access memory (RAM), dynamic RAM (DRAM), or static RAM (SRAM). The non-volatile memory may be, for example, electrically erasable programmable read-only memory (EEPROM), flash memory, magnetic RAM (MRAM), spin-transfer torque MRAM, ferroelectric RAM (FeRAM), phase-change RAM (PRAM), or resistive RAM (RRAM).

To control the operations of the PMIC 510, the AP 520 typically executes computer instructions that cause the power manager 525 to communicate with the PMIC 510 to control its operations. The computer instructions are typically software or firmware, or a combination thereof. The software and/or firmware is typically stored in a non-transitory computer-readable medium, which may be, for example, memory 540 or on-board memory (not shown) of the AP 520. The AP 520 may be any suitable computing device such as, for example, a microprocessor, a microcontroller, an application specific integrated circuit (ASIC), a digital signal processor (DSP), a field programmable gate array (FPGA), or a programmable logic array (PLA).

It can be seen from the foregoing description of the exemplary embodiments that a voltage regulator is provided that is capable of decreasing driving current necessary for the operation of the voltage regulator, even in cases where the voltage regulator has multiple outputs. In addition, because the voltage regulator has only a single error amplifier for generating the multiple outputs, the size of the voltage regulator and the driving current it generates are decreased while generating the multiple outputs.

Exemplary embodiments have been described herein for the purposes of demonstrating inventive principles and concepts. It will be understood by those of skill in the art that the inventive principles and concepts extend beyond the exemplary embodiments, in view of the description provided herein. As will be understood by those of skill in the art, a variety of modifications may be made to the embodiments described herein without departing from the scope of the inventive concepts and that all such modifications are within the scope of the invention.

What is claimed is:

1. A voltage regulator comprising:

an error amplifier circuit comprising a first amplifier including a first transistor and a second transistor, and a second amplifier including the first transistor and a third transistor, the first amplifier being configured to receive a reference voltage input to a first gate of the first transistor and a first feedback voltage input to a second gate of the second transistor, amplify a difference between the reference voltage and the first feedback voltage using the first transistor and the second transistor, and generate a first output signal as a result of amplifying by the first amplifier, the second amplifier being configured to receive the reference voltage input to the first gate of the first transistor and a second feedback voltage input to a third gate of the third transistor, amplify a difference between the reference voltage and the second feedback voltage using the first transistor and the third transistor, and generate a second output signal as a result of amplifying by the second amplifier;

a first power transistor configured to be placed in an on state or an off state in response to the first output signal; and a second power transistor configured to be placed in an on state or an off state in response to the second output signal, wherein the first amplifier and the second amplifier share the first transistor.

2. The voltage regulator of claim 1, wherein the first, second and third transistors share a same characteristic.

3. The voltage regulator of claim 1, further comprising:

a first power line configured to supply a first operating voltage to the error amplifier circuit; and a second power line configured to supply a second operating voltage to the first and second power transistors, wherein a level of the first operating voltage is different from a level of the second operating voltage.

4. The voltage regulator of claim 1, further comprising:

a first power line configured to supply a first operating voltage to the error amplifier circuit;

a second power line configured to supply a second operating voltage to the first power transistor; and a third power line configured to supply a third operating voltage to the second power transistor, wherein a level of the first operating voltage, a level of the second operating voltage and a level of the third operating voltage are different from one another.

5. The voltage regulator of claim 1, further comprising:

a first power line configured to supply a first operating voltage to the error amplifier circuit;

a second power line configured to supply a second operating voltage to the first power transistor; and a third power line configured to supply a third operating voltage to the second power transistor, wherein a level of the first operating voltage, a level of the second operating voltage and a level of the third operating voltage are different from one another, and wherein a first source of the first power transistor is connected to a second source of the second power transistor.

6. The voltage regulator of claim 2, wherein the first amplifier includes a first mirror current branch and a reference current branch, the first mirror current branch receiving a voltage from the second transistor, the reference current branch receiving a voltage from the first transistor and determining, based on the voltage received from the first transistor, whether to cause a first intermediate output signal to be output from the first mirror current branch to a buffer circuit of the error amplifier circuit, and wherein the second amplifier includes a second mirror current branch that receives a voltage from the third transistor, the reference current branch determining, based on the voltage received from the first transistor, whether to cause a second intermediate output signal to be output from the second mirror current branch to the buffer circuit, and wherein the first and second amplifiers share the reference current branch.

7. The voltage regulator of claim 6, wherein the buffer circuit includes a first buffer and a second buffer, the first buffer generating the first output signal by increasing a driving capacity of the first intermediate output signal, the second buffer generating the second output signal by increasing a driving capacity of the second intermediate output signal.

8. The voltage regulator of claim 7, wherein the first transistor, the second transistor and the third transistor are one of p-channel metal oxide semiconductor (PMOS) transistors and n-channel metal oxide semiconductor (NMOS) transistors.

9. The voltage regulator of claim 8, further comprising:

a first power line configured to supply a first operating voltage to the error amplifier circuit, the first power transistor and the second power transistor.

10. An integrated circuit comprising:

at least one power source configured to supply an operating power; and a voltage regulator that receives the operating power from the power source, the voltage regulator comprising an error amplifier circuit comprising a first amplifier including a first transistor and a second transistor, and a second amplifier including the first transistor and a third transistor, the first amplifier being configured to receive a reference voltage input to a first gate of the first transistor and a first feedback voltage input to a second gate of the second transistor, amplify a difference between the reference voltage and the first feedback voltage using the first transistor and the second transistor, and generate a first output signal as a result of amplifying by the first amplifier, the second amplifier being configured to receive the reference voltage input to the first gate of the first transistor and a second feedback voltage input to a third gate of the third transistor, amplify a difference between the reference voltage and the second feedback voltage using the first transistor and the third transistor, and to generate a second output signal as a result of amplifying by the second amplifier, a first power transistor configured to be placed in an on state or an off state in response to the first output signal, and a second power transistor configured to be placed in an on state or an off state in response to the second output signal, wherein the first amplifier and the second amplifier share the first transistor.

11. The integrated circuit of claim 10, wherein the first, second and third transistors share a same characteristic.

12. The integrated circuit of claim 10, wherein said at least one power source comprises at least first, second and third power sources that provide first, second and third operating voltages, respectively, via first, second and third power lines, respectively, of the integrated circuit, the first, second and third operating voltages being different from one another, the error amplifier circuit receiving the first operating voltage, the first power transistor receiving the second operating voltage and the second power transistor receiving the third operating voltage.

13. The integrated circuit of claim 11, wherein the first amplifier includes a first mirror current branch and a reference current branch, the first mirror current branch receiving a voltage from the second transistor, the reference current branch receiving a voltage from the first transistor and determining, based on the voltage received from the first transistor, whether to cause a first intermediate output signal to be output from the first mirror current branch to a buffer circuit of the error amplifier circuit, and wherein the second amplifier includes a second mirror current branch that receives a voltage from the third transistor, the reference current branch determining, based on the voltage received from the first transistor, whether to cause a second intermediate output signal to be output from the second mirror current branch to the buffer circuit, and wherein the first and second amplifiers share the reference current branch.

14. The integrated circuit of claim 12, wherein the first, second and third transistors share a same characteristic.

15. The integrated circuit of claim 12, wherein the integrated circuit is used to regulate power usage in a mobile device, the mobile device being one of a laptop computer, a cellular phone, a smart phone, a tablet personal computer (PC), a personal digital assistant (PDA), an enterprise digital assistant (EDA), a digital still camera, a digital video camera, a portable multimedia player (PMP), a personal navigation device or portable navigation device (PND), a handheld game console, a mobile internet device (MID), a wearable computer, an internet of things (IoT) device, an internet of everything (IoE) device, a drone, or an electronic book (e-book).

16. The integrated circuit of claim 13, wherein the buffer circuit includes a first buffer and a second buffer, the first buffer generating the first output signal by increasing a driving capacity of the first intermediate output signal, the second buffer generating the second output signal by increasing a driving capacity of the second intermediate output signal.

17. The integrated circuit of claim 14, wherein the first amplifier includes a first mirror current branch and a reference current branch, the first mirror current branch receiving a voltage from the second transistor, the reference current branch receiving a voltage from the first transistor and determining, based on the voltage received from the first transistor, whether to cause a first intermediate output signal to be output from the first mirror current branch to a buffer circuit of the error amplifier circuit, and wherein the second amplifier includes a second mirror current branch that receives a voltage from the third transistor, the reference current branch determining, based on the voltage received from the first transistor, whether to cause a second intermediate output signal to be output from the second mirror current branch to the buffer circuit, and wherein the first and second amplifiers share the reference current branch.

18. The integrated circuit of claim 16, wherein the first, second and third transistors are one of p-channel metal oxide semiconductor (PMOS) transistors and n-channel metal oxide semiconductor (NMOS) transistors.

19. The integrated circuit of claim 17, wherein the buffer circuit includes a first buffer and a second buffer, the first buffer generating the first output signal by increasing a driving capacity of the first intermediate output signal, the second buffer generating the second output signal by increasing a driving capacity of the second intermediate output signal.

20. The integrated circuit of claim 19, wherein the first transistor, the second transistor and the third transistor are one of p-channel metal oxide semiconductor (PMOS) transistors and n-channel metal oxide semiconductor (NMOS) transistors.

* * * * *